US011856385B2

(12) United States Patent
Dvecko

(10) Patent No.: US 11,856,385 B2
(45) Date of Patent: Dec. 26, 2023

(54) AUDIO SIGNAL PROCESSING METHOD AND DEVICE

(71) Applicant: MOZZAIK IO d.o.o., Zagreb (HR)

(72) Inventor: Marko Dvecko, Krizevci (HR)

(73) Assignee: MOZZAIK IO d.o.o.

( * ) Notice: Subject to any disclaimer, the term of this patent is extended or adjusted under 35 U.S.C. 154(b) by 154 days.

(21) Appl. No.: 17/431,017

(22) PCT Filed: Oct. 22, 2019

(86) PCT No.: PCT/HR2019/000027
§ 371 (c)(1),
(2) Date: Aug. 13, 2021

(87) PCT Pub. No.: WO2020/165616
PCT Pub. Date: Aug. 20, 2020

(65) Prior Publication Data

US 2022/0141610 A1 May 5, 2022

(30) Foreign Application Priority Data

Feb. 13, 2019 (HR) ..... P20190292A
Oct. 21, 2019 (HR) ..... P20191903A

(51) Int. Cl.
*H04S 7/00* (2006.01)
*H04R 3/08* (2006.01)
*H04S 1/00* (2006.01)

(52) U.S. Cl.
CPC ..... *H04S 7/301* (2013.01); *H04R 3/08* (2013.01); *H04S 1/002* (2013.01); *H04S 2400/09* (2013.01)

(58) Field of Classification Search
None
See application file for complete search history.

(56) References Cited

U.S. PATENT DOCUMENTS

2006/0133620 A1 6/2006 Lashkari
2011/0257982 A1* 10/2011 Smithers ..... G10L 19/022 704/500

(Continued)

FOREIGN PATENT DOCUMENTS

EP 0841836 A2 5/1998
WO 2018075442 A1 4/2018

OTHER PUBLICATIONS

International Preliminary Report on Patentability dated Oct. 3, 2021 issued in International Patent Application PCT/HR2019/000027.

(Continued)

*Primary Examiner* — Walter F Briney, III
(74) *Attorney, Agent, or Firm* — ST ONGE STEWARD JOHNSTON AND REENS LLC

(57) ABSTRACT

A method and apparatus for audio signal processing in an audio chain to correct a non-linearity of the electroacoustic transducers in the audio chain by adding non-linearities in the audio chain in front of at least one electroacoustic transducer in the audio chain using an approximation of the quadratic function. The method accommodates the psycho-acoustical characteristics of the human ear by adding non-linearities in the audio chain in front of at least one electroacoustic transducer in the audio chain approximating by a non-linear fifth degree polynomial function for a pressure change by the human ear up to p_Δ. The method and apparatus reduce non-linearities of the entire audio chain with the human ear, by adding non-linearities in the audio chain so that an audio chain characteristic reduces the non-linearity of the human ear polynomial approximation to the pressure change p_Δ=±1 Pa.

18 Claims, 20 Drawing Sheets

(56) References Cited

U.S. PATENT DOCUMENTS

2015/0146890 A1* 5/2015 Yang ..... H03G 3/20
381/119
2017/0061982 A1* 3/2017 Pakarinen ..... H03G 5/005

OTHER PUBLICATIONS

International Search Report and Written Opinion of the Searching Authority dated Feb. 17, 2020 issued in International Patent Application PCT/HR2019/000027.
Klippel, Wolfgang. "The Mirror Filter—A New Basis for Reducing Nonlinear Distortion and Equalizing Response in Woofer Systems", J. Audio Eng. Soc., vol. 40, No. 9, pp. 675-691, (Sep. 30, 1992).
Klippel, Wolfgang. "Active Compensation of Transducer Nonlinearities", AES 23rd International Conference, Copenhagen, Denmark, May 23-25, 2003, pp. 1-17.
Wee-Tong, Lim et al, "Synthesis of Polynomial-Based Nonlineal Device and Harmonic Shifting Technique for Virtual Bass System", Circuits and Systems, 2009. ISCAS 2009. IEEE International Symposium on, IEEE, Piscataway, NJ, USA, May 24, 2009, pp. 1871-1874.

* cited by examiner

AUDIO SIGNAL PROCESSING METHOD AND DEVICE

FIELD OF THE INVENTION

The present invention refers to an audio signal processing method for enhancing the quality and/or other characteristic of an audio signal. This method corrects a non-linearity of electro-acoustic transducers in an audio chain by taking into account also a non-linear psychoacoustical characteristics of the human ear by adding non-linearities in the audio chain in a controlled manner. Furthermore, the present invention relates to a device/apparatus for the implementation of said method and audio chain configured to correct the non-linearity of electroacoustic transducers, taking into account also the non-linear psychoacoustical characteristics of the human ear. The audio chain contains at least one apparatus for the implementation of the audio signal processing method.

Nowadays, the audio chain before the electroacoustic converter displays impeccable features. It is not known why some audio chain components with greater distortions produce better sound than components with lower distortion. Some amplifiers have incorporated vacuum tubes in order to sound better, whereas other employ a small feedback loop to intensify non-linearities of the components. The audio chain distortions before the electroacoustic transducer do not mean that it will sound better or worse. Two different electroacoustic transducers that sound good on their audio chains, will sound worse when they swap places. One of the reasons thereof is that the audio chain before the electroacoustic transducer has non-linearities that reduce its non-linearities which makes it sound better than on the other audio chain.

Technical problem that gets solved with the present invention is a method and an apparatus for audio signal processing in audio chain, that correct non-linearity of electroacoustic transducers in audio chain, taking into account also the non-linear psychoacoustic feature of the human ear.

BACKGROUND OF THE INVENTION

Non-linearities of the electroacoustic transducers have been known for some time now. Non-linear distortions characterize the entire electroacoustic reproduction chain, from the sound recording process on the sound recording medium all the way to the reproduction of sound from the sound recording medium, the amplifier and the loudspeaker itself. There are many publications documenting these non-linearities. The application of non-linearities in musical instruments in order to change the sound has also been known for a while. People do not perceive some non-linearities in the sound, whereas others are perceived, even though they have the same acoustic energy as described in the article *Amplifier Musicality—A Study of Amplifier Harmonic Distortion Spectrum Analysis by Jean Hiraga*. The document U.S. Pat. No. 5,133,015 discloses the process and the apparatus for audio signal processing, more precisely, the technique that permits various audio signal distortion grades comprising the audio signal distortion to a certain grade. The document US2011255701 discloses the electronic circuit and the audio enhancement method, particularly the electronic circuit that can introduce a predictive and controllable harmonic distortion that increases with an increased signal amplitude. The document US2015249889 discloses the system and the method for digital audio signal processing by extending the loudspeaker frequency response and reducing or eliminating non-linear loudspeaker distortion. An audio signal can be extended by applying a digital linear filter, based on a modified loudspeaker frequency response. A non-linear distortion of a loudspeaker can be cancelled or reduced by a digital non-linear filter based on a reverse parametric model of the loudspeaker.

Most of the known conventional approaches related to audio signal processing with the view to enhancing the quality and/or other characteristics of audio signal do not take into consideration also the non-linear psychoacoustical characteristic of the human ear.

SUMMARY OF THE INVENTION

The present invention relates to an audio signal processing method and apparatus in an audio chain that correct a non-linearity of electroacoustic transducers in the audio chain, taking into consideration also a non-linear psychoacoustical characteristics of the human ear by adding non-linearities in the audio chain in a controlled manner, in order to obtain a better acoustic image and more details when reproducing the sound by using approximation of the quadratic and a fifth degree polynomial function in some range.

According to the present invention, a method comprises approximating of the non-linear psychoacoustical characteristic of the human ear by a fifth-degree polynomial and adding of at least one non-linear element in front of at least one electroacoustic transducer in the audio chain, whereby the non-linear element has a function of adding a non-linearity in the audio chain that corrects the non-linearity of at least one electroacoustic transducer and/or the non-linearity of the approximated psychoacoustical characteristic of the human ear for a pressure change by the human ear up to $p_\Delta$.

The audio chain for implementing of said audio signal processing method, according to the present invention, is configured to correct the non-linearity of electroacoustic transducers in the audio chain, taking into account also the non-linear psychoacoustical characteristic of the human ear. Said audio chain contains at least one apparatus for implementing of the audio signal processing method. The aforementioned apparatus has the function of adding the non-linearity to the audio chain that corrects the non-linearity of at least one electroacoustic transducer and/or the non-linearity of the approximate psychoacoustical characteristic of the human ear for the pressure change by the human ear up to $p_\Delta$.

The method of the present invention, the apparatus and the audio chain reduce limitations of the electroacoustic transducers as well as of the human ear by adding non-linearities that, ultimately reduce non-linearities of an entire audio chain with the human ear, i.e. adding non-linearities to the audio chain so that an audio chain characteristic reduces the non-linearity of the human ear polynomial approximation to the change of pressures $p_\Delta = \pm 1$ Pa.

BRIEF DESCRIPTION OF THE DRAWINGS

In the following, the invention shall be described in detail with reference to the drawings, wherein.

Figure 1A:
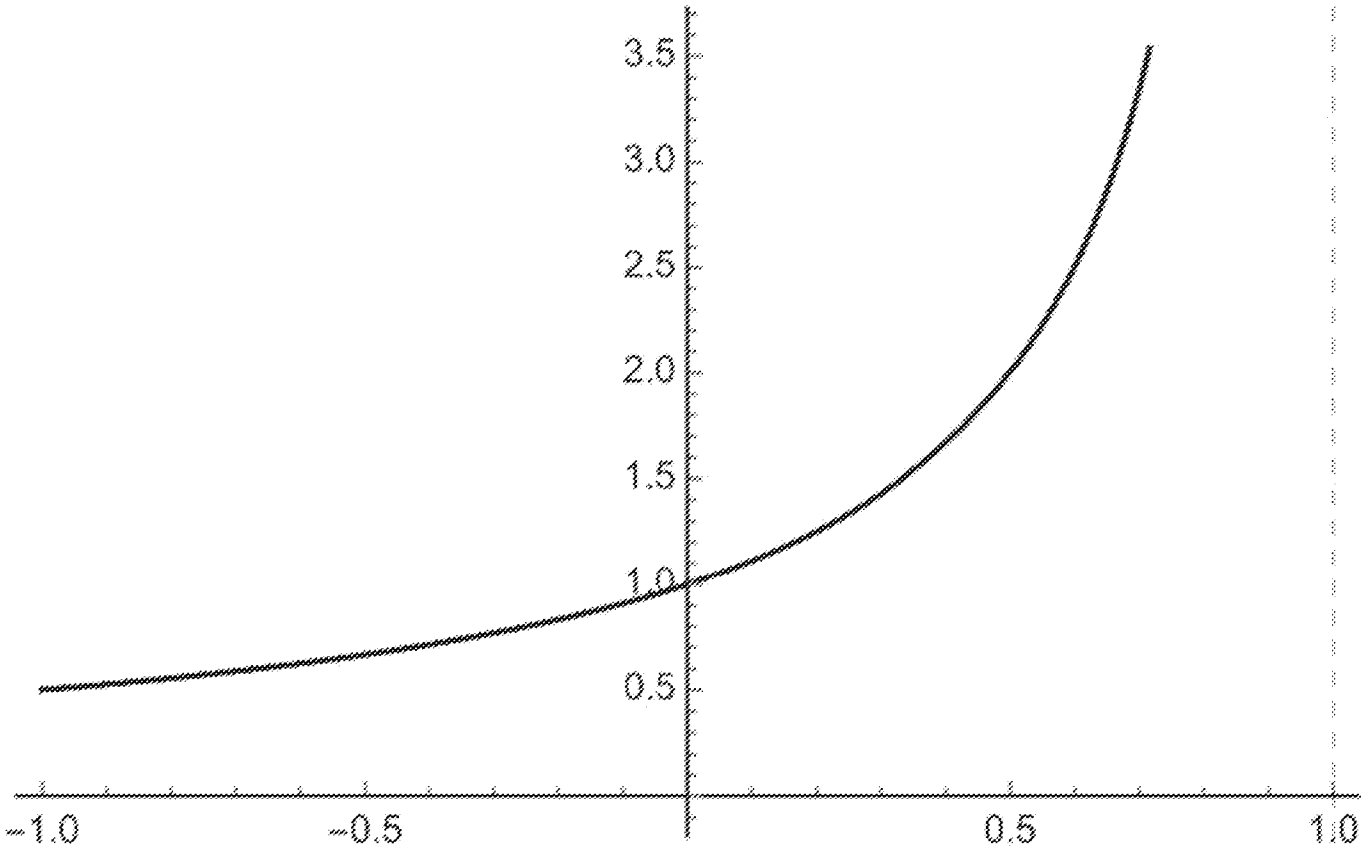
FIG. 1*a* is a diagram of the hyperbolic function $$\frac{1}{1-x}$$
Figure 1B:
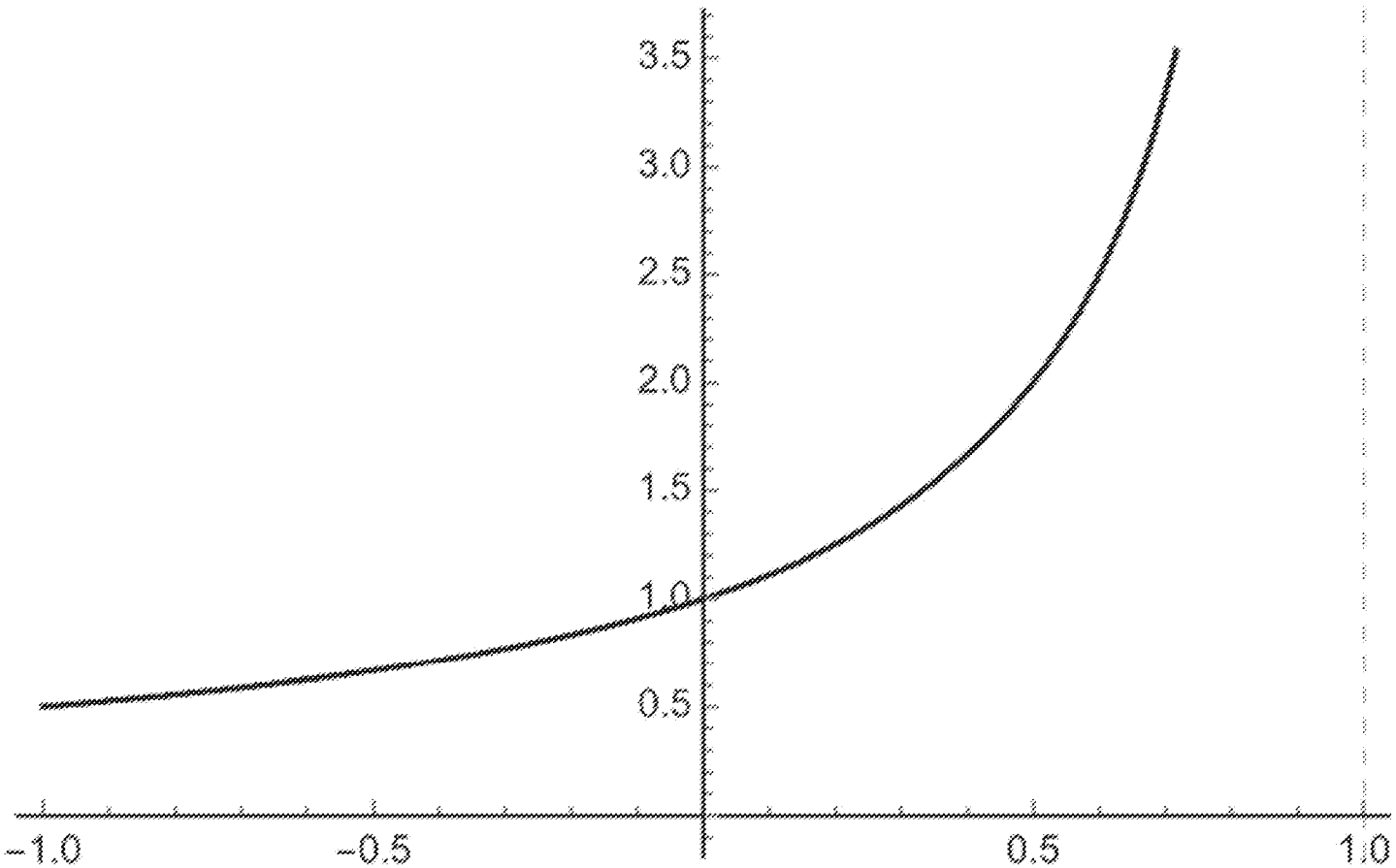

with asymptotes;

FIG. 1*b* illustrates a harmonic spectrum of a distorted sinusoidal signal with an amplitude 0.57 of the function shown on the FIG. 1*a;*

Figure 2A:
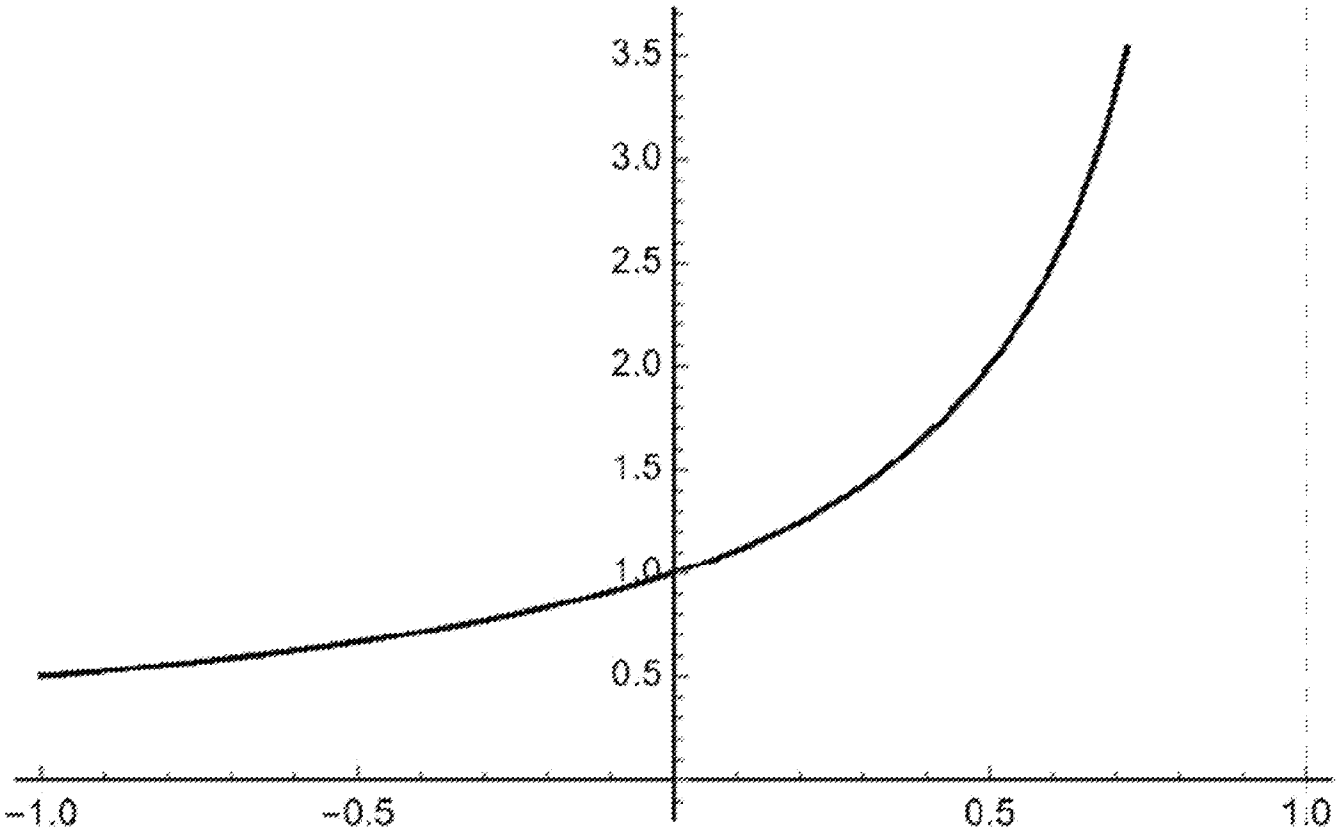
Figure 2B:
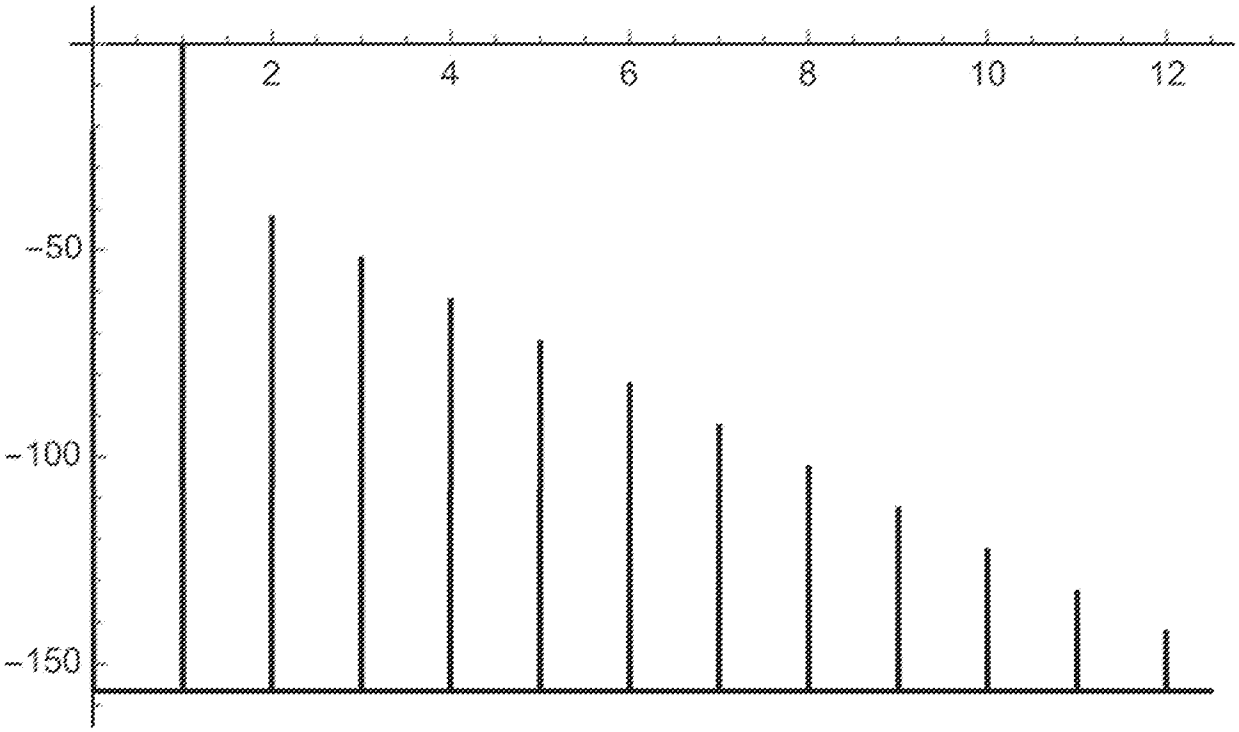

FIG. 2*a* is a diagram of the hyperbolic function $$x+\frac{1}{50(1-x)}$$

with asymptotes;

FIG. 2*b* illustrates a harmonic spectrum of a distorted sinusoidal signal with an amplitude 0.57 of the function shown on the FIG. 2*a;*

Figure 3A:
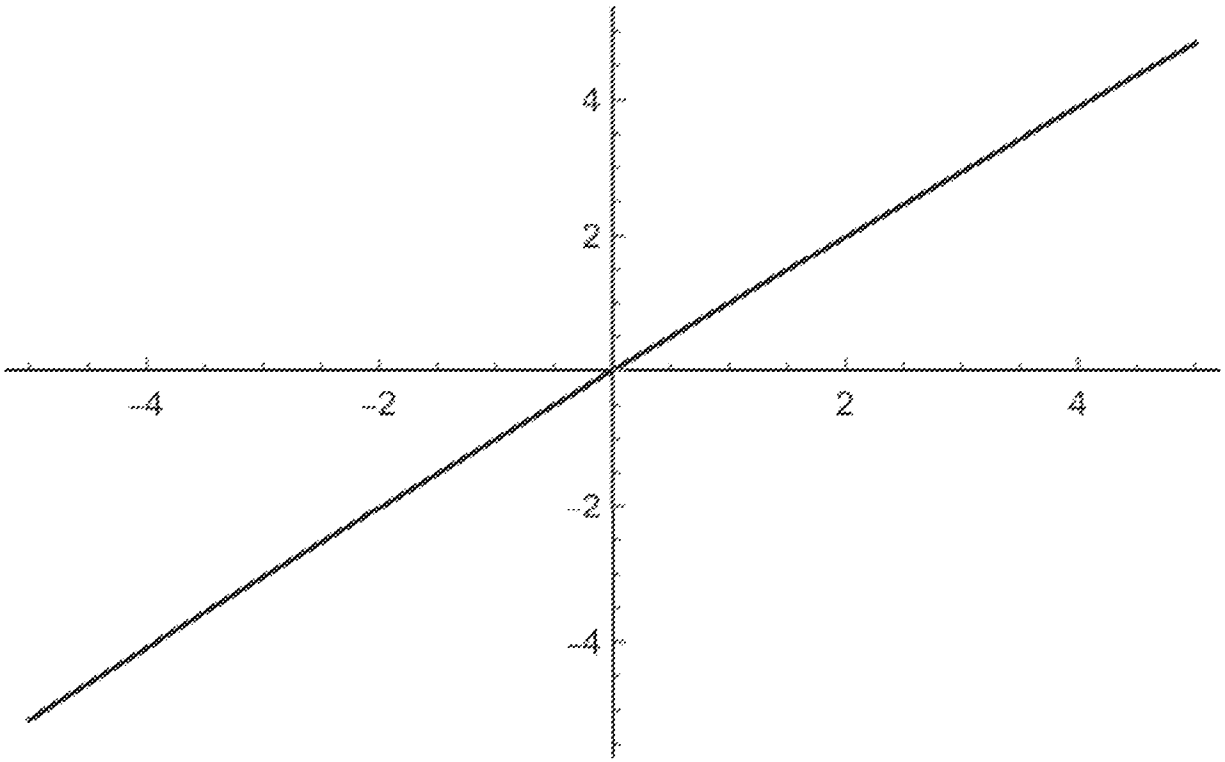

FIG. 3*a* illustrates a diagram of the approximated psychoacoustical characteristic of the human ear $$x-10^{-\frac{44.5}{20}}x^2-10^{-\frac{79.5}{20}}x^3-10^{-\frac{101}{20}}x^4-10^{-\frac{130}{20}}x^5;$$

Figure 3B:
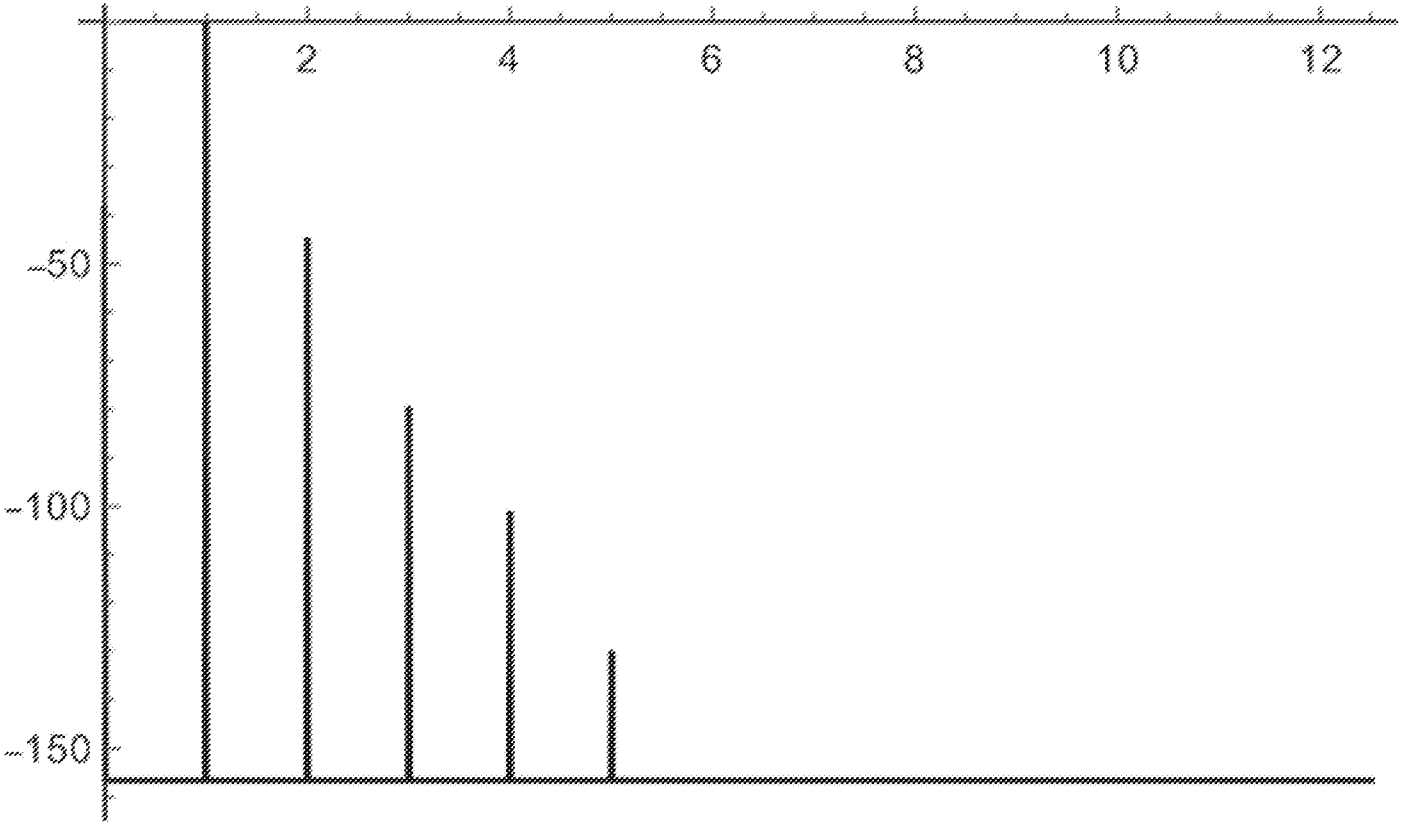

FIG. 3*b* illustrates a harmonic spectrum of a distorted sinusoidal signal with an amplitude 2 of the function shown on the FIG. 3*a;*

Figure 4A:
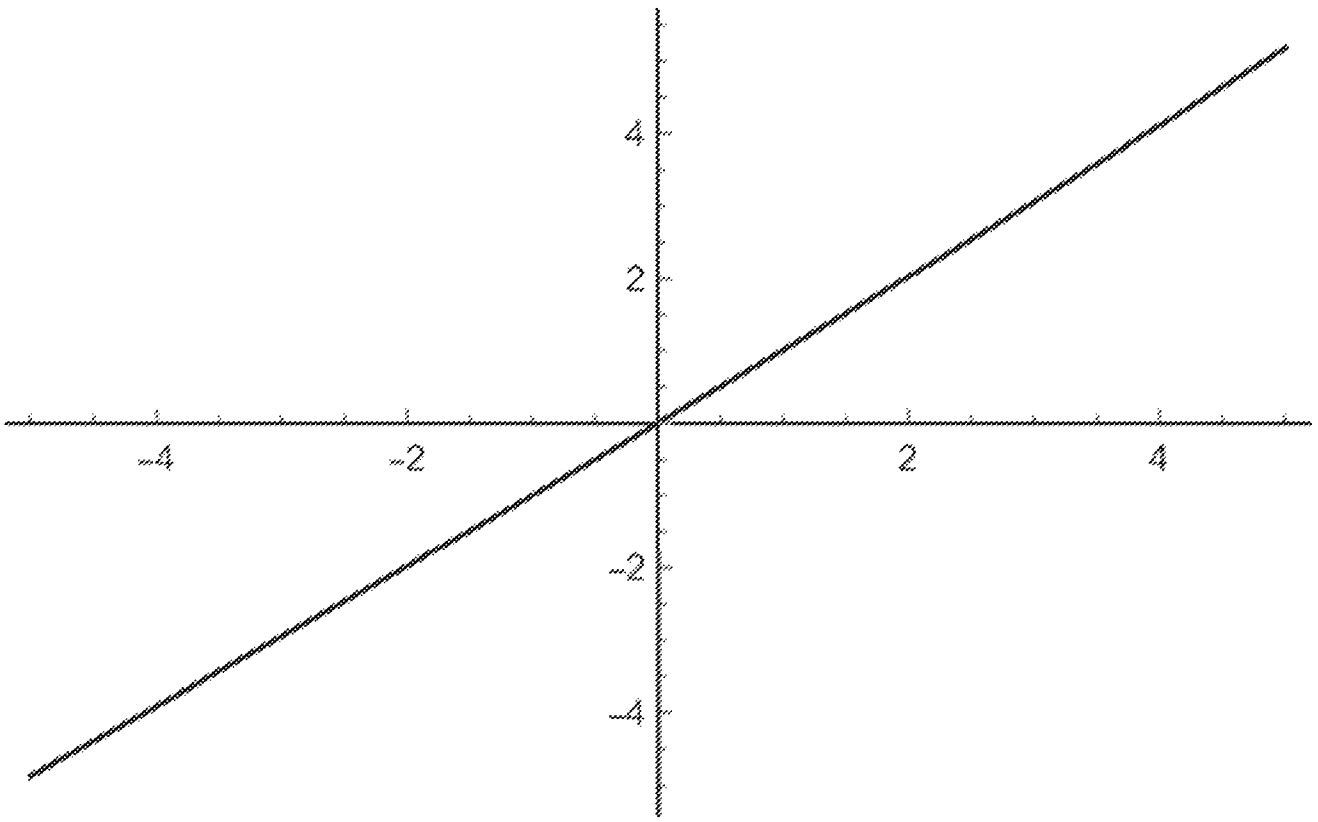

FIG. 4*a* is an inverse approximated psychoacoustical characteristic of the human ear $$x-10^{-\frac{44.5}{20}}x^2-10^{-\frac{75}{20}}x^3-10^{-\frac{97.6}{20}}x^4-10^{-\frac{122.3}{20}}x^5;$$

Figure 4B:
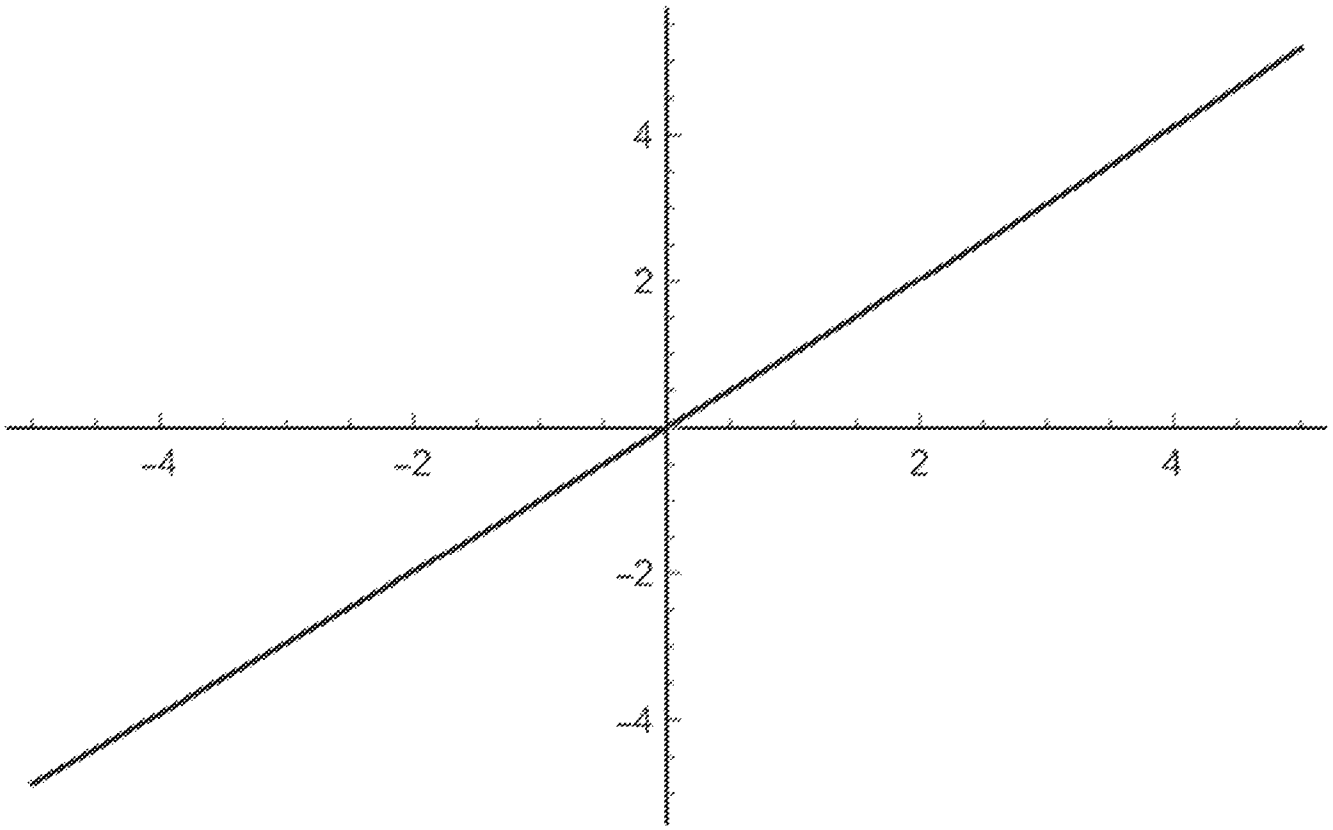

FIG. 4*b* illustrates a harmonic spectrum of a distorted sinusoidal signal with an amplitude 2 of the function shown on the FIG. 4*a;*

Figure 5A:
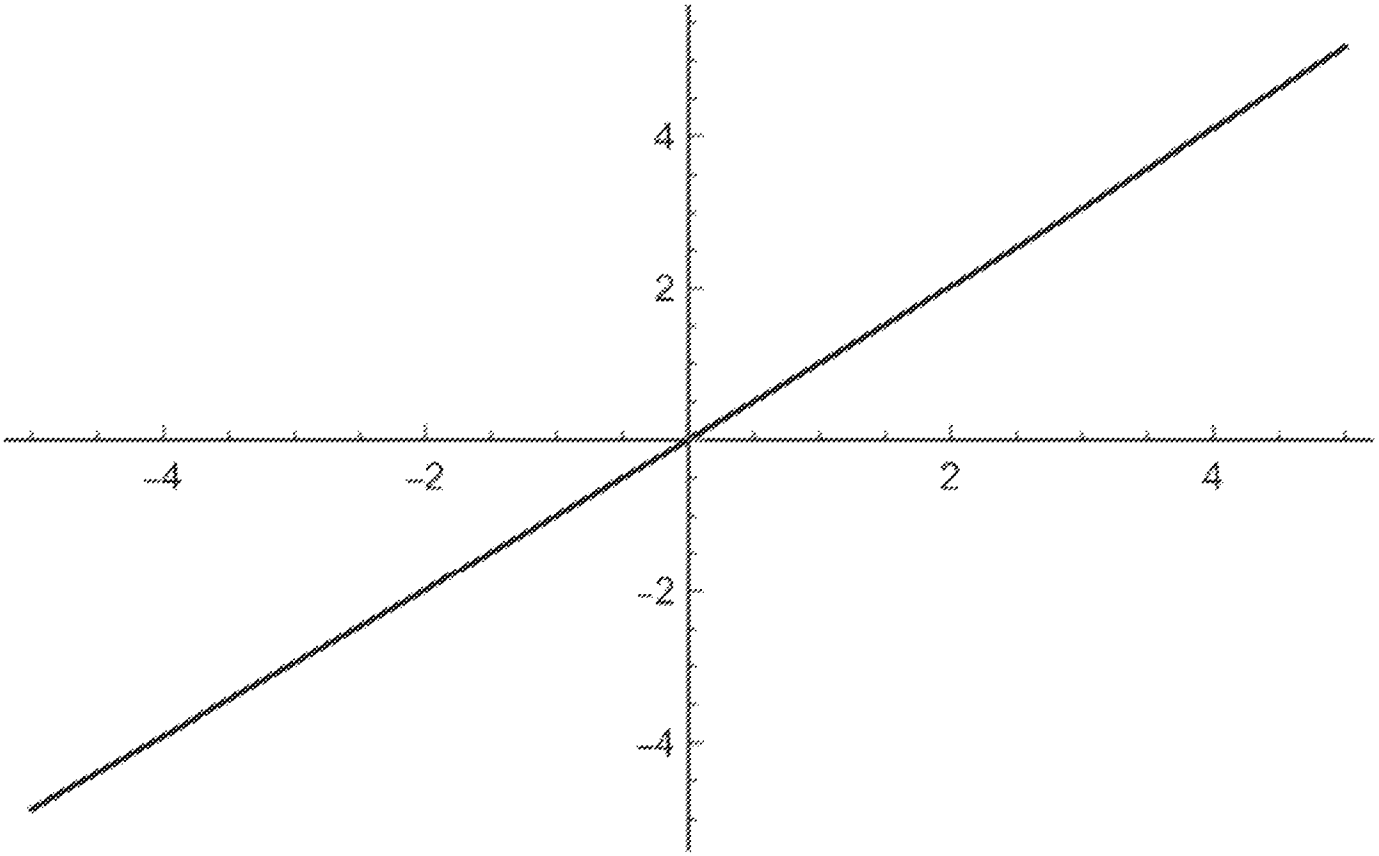

FIG. 5*a* illustrates a diagram of an inverse approximation of the psychoacoustical characteristic of the human ear by hyperbolic functions $$x+\frac{0.003472x^2}{1-0.06061x}+\frac{0.002484x^2}{1+0.01313x};$$

Figure 5B:
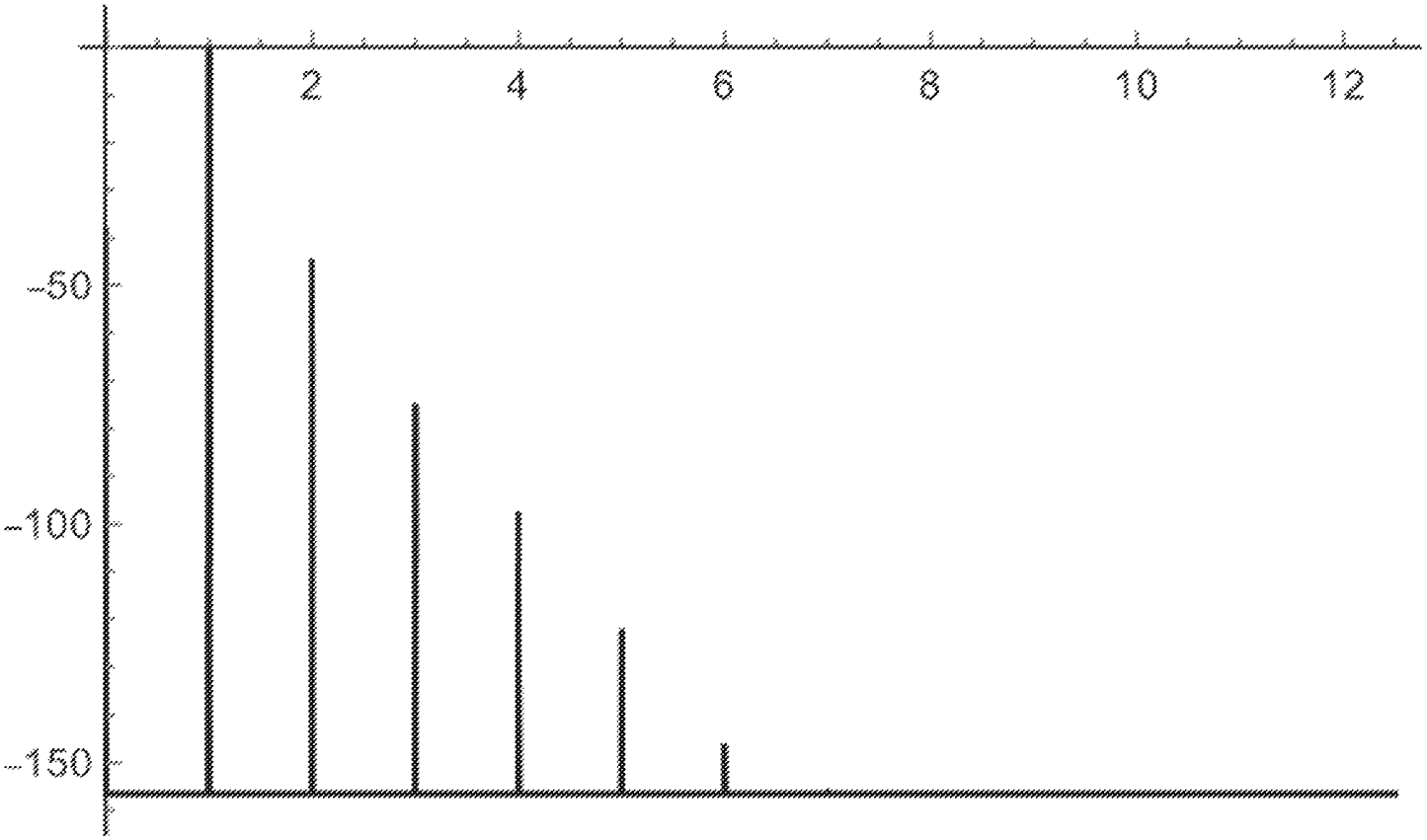

FIG. 5*b* illustrates a harmonic spectrum of a distorted sinusoidal signal with an amplitude 2 of the function shown on the FIG. 5*a,*

Figure 6A:
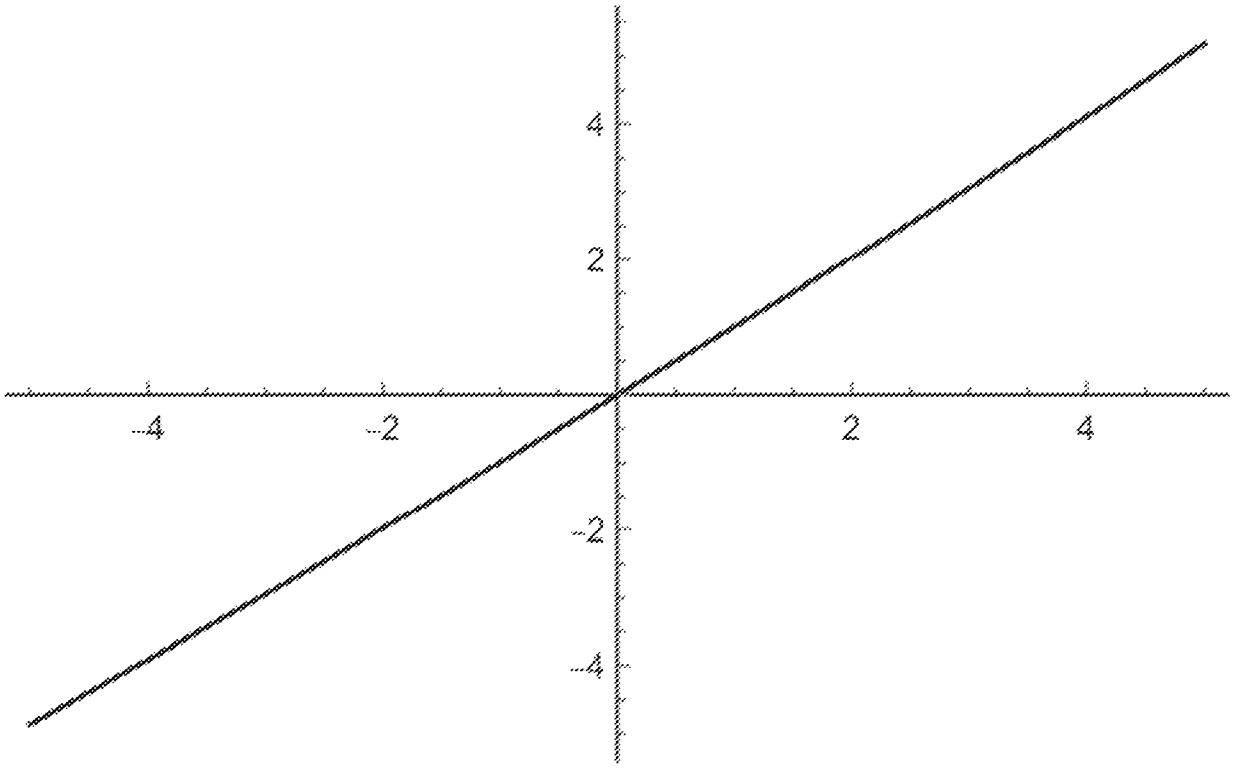
Figure 6B:
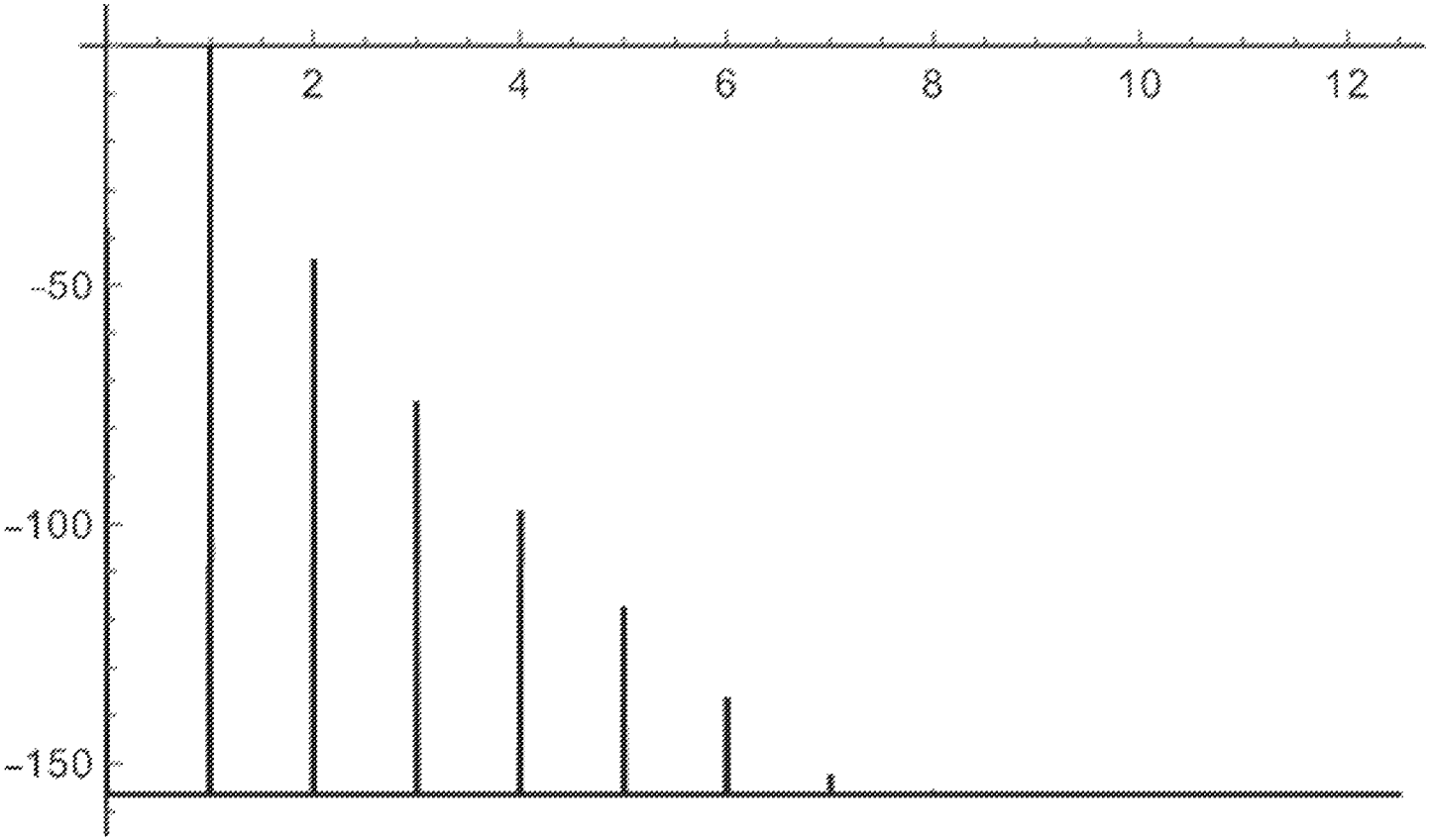

FIG. 6*a* illustrates an approximation diagram of the inverse psychoacoustical characteristic of the human ear employing a vacuum diode $x+((a-x)^{1.5}-a^{1.5}+1.5\cdot a^{0.5}\ x)\cdot b$, where a=5.31423 and b=0.0366175;

FIG. 6*b* illustrates a harmonic spectrum of a distorted sinusoidal signal with an amplitude 2 of the function shown on the FIG. 6*a;*

Figure 7:
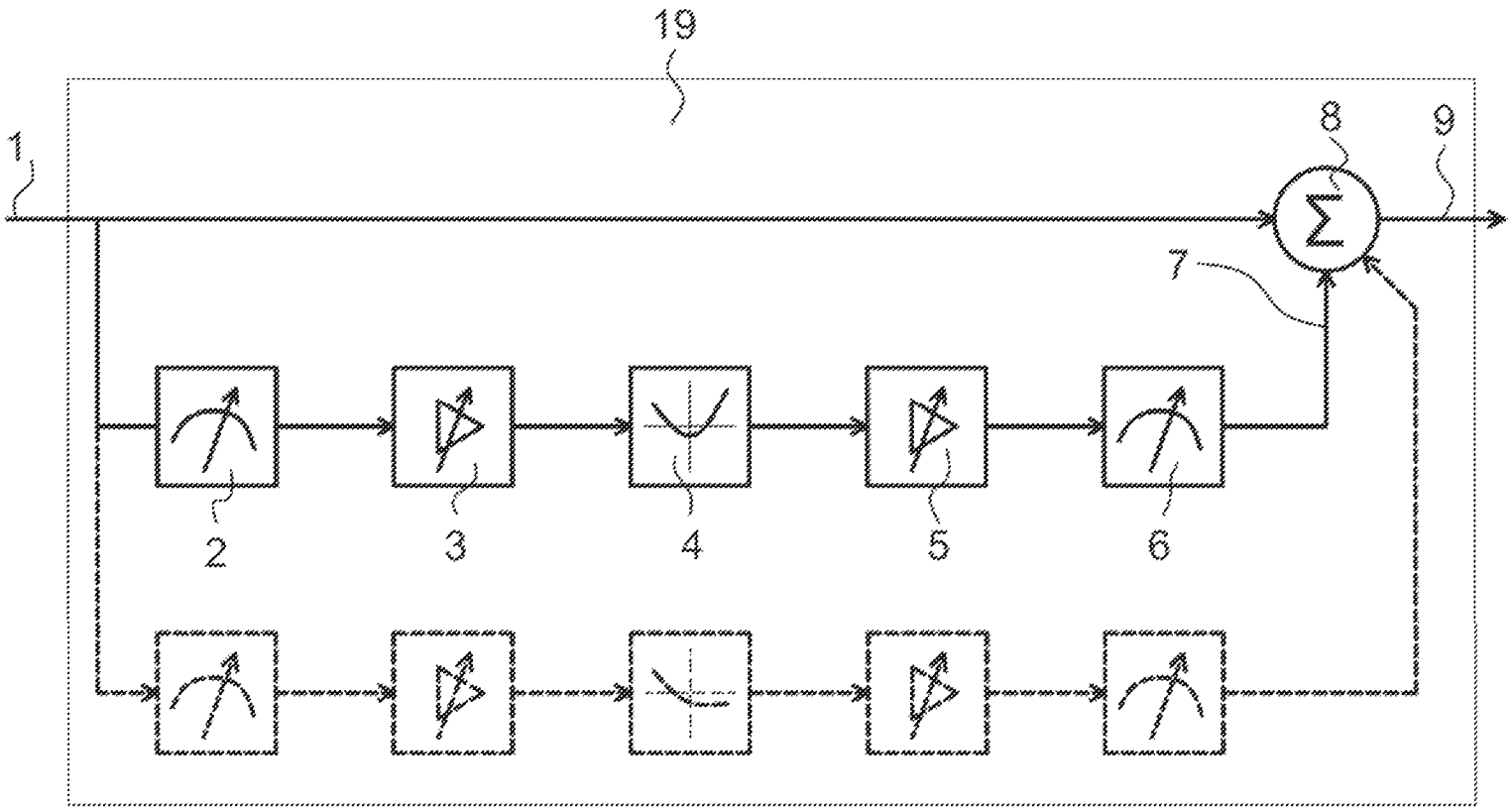
Figure 8:
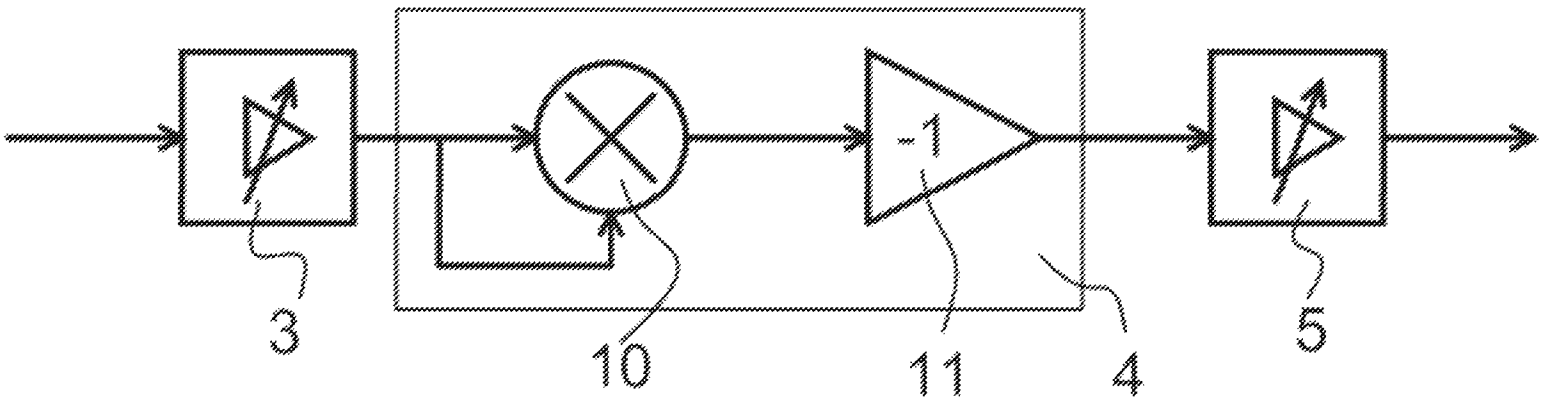
Figure 9:
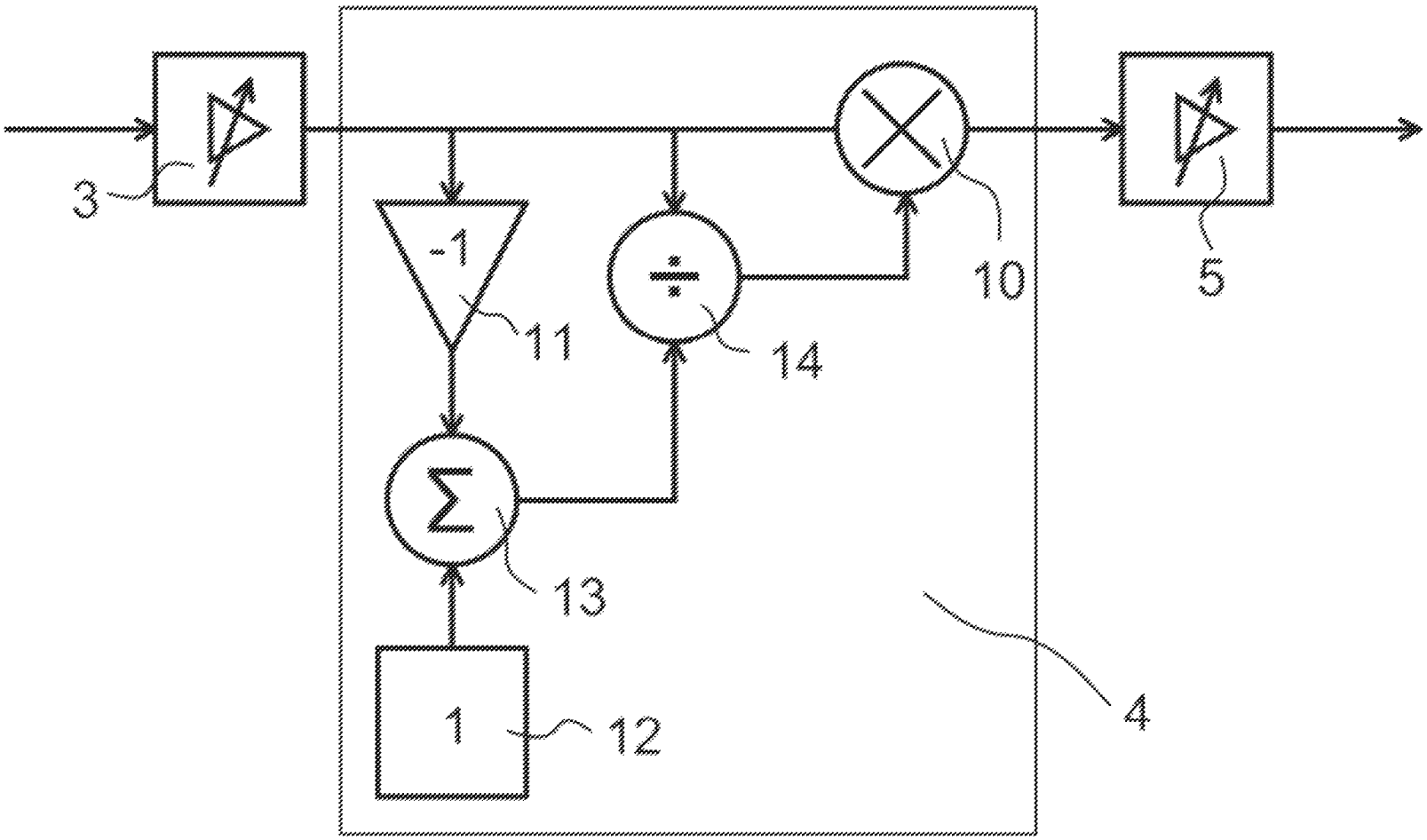

FIG. 7 schematically illustrates an apparatus for implementing a method of adding non-linearities in an audio signal in accordance with the present invention;

FIG. 8 schematically illustrates derivation of a non-linear square element of the function $-ax^2$;

FIG. 9 schematically illustrates derivation of a non-linear hyperbolic element of the function $$\frac{ax^2}{b-x};$$

Figure 10:
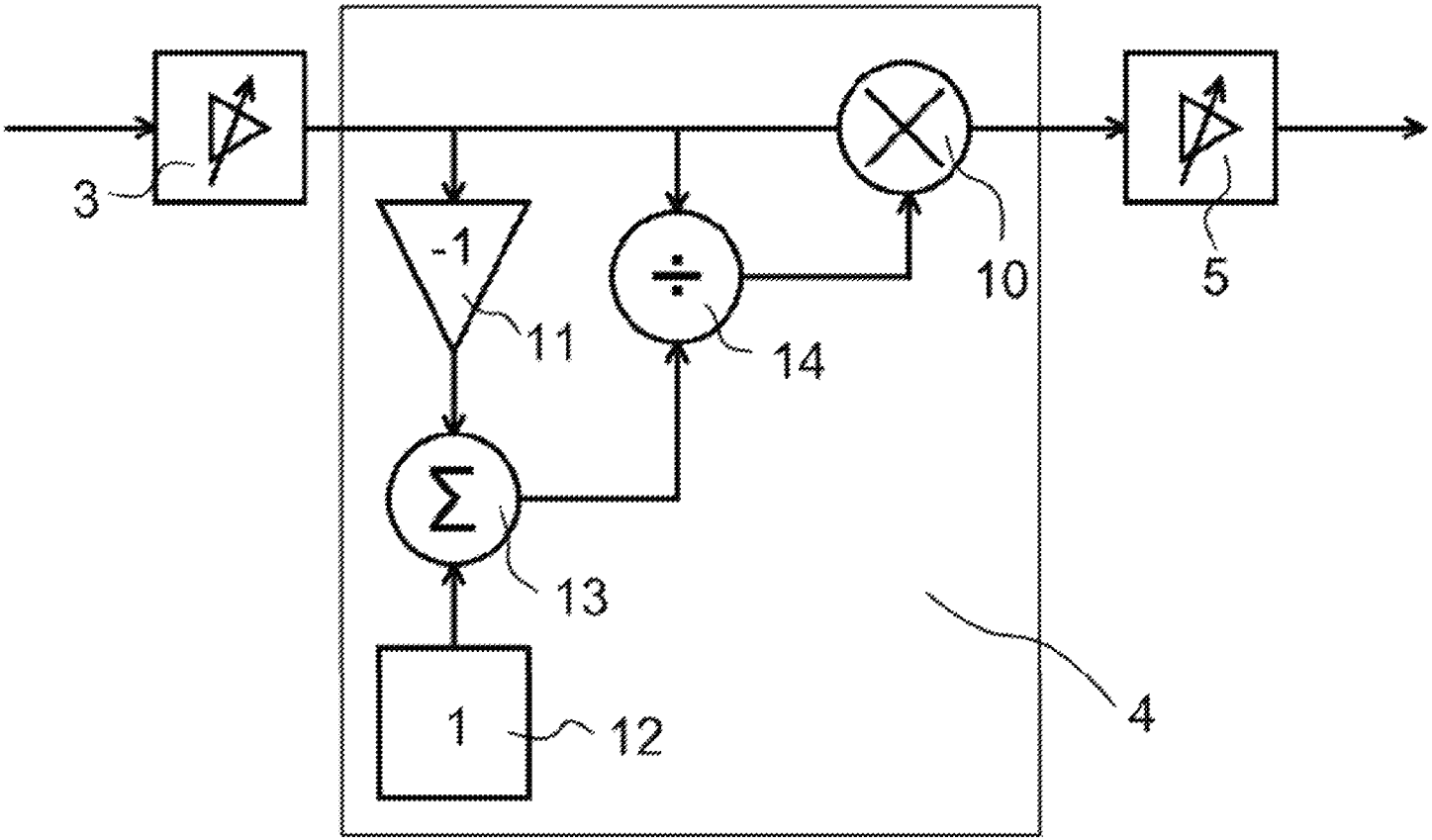

FIG. 10 schematically illustrates derivation of a non-linear hyperbolic element of the function $$\frac{ax^2}{b+x};$$

Figure 11:
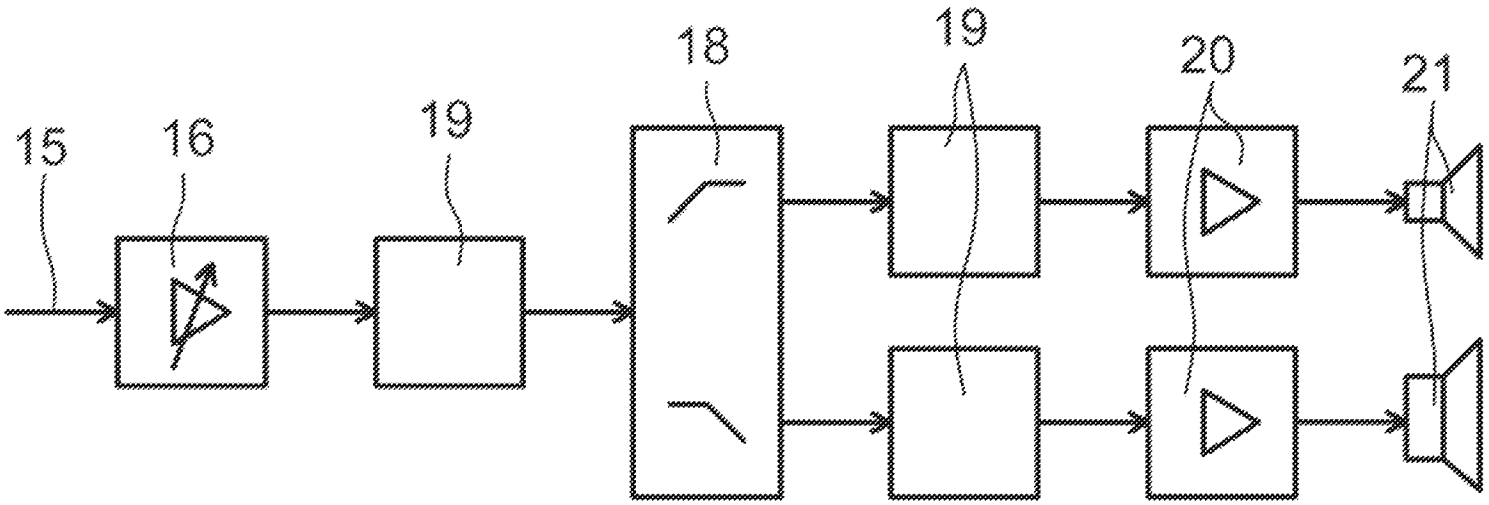
Figure 12:
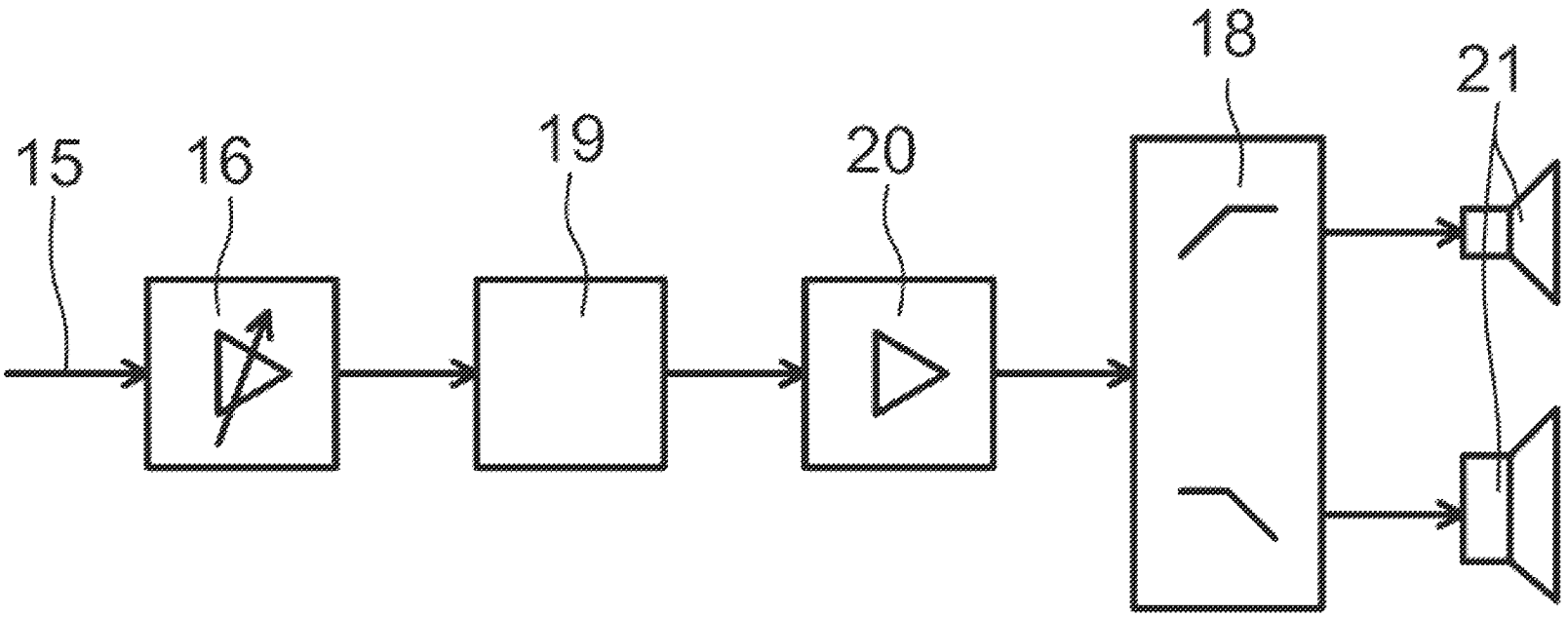
Figure 13:
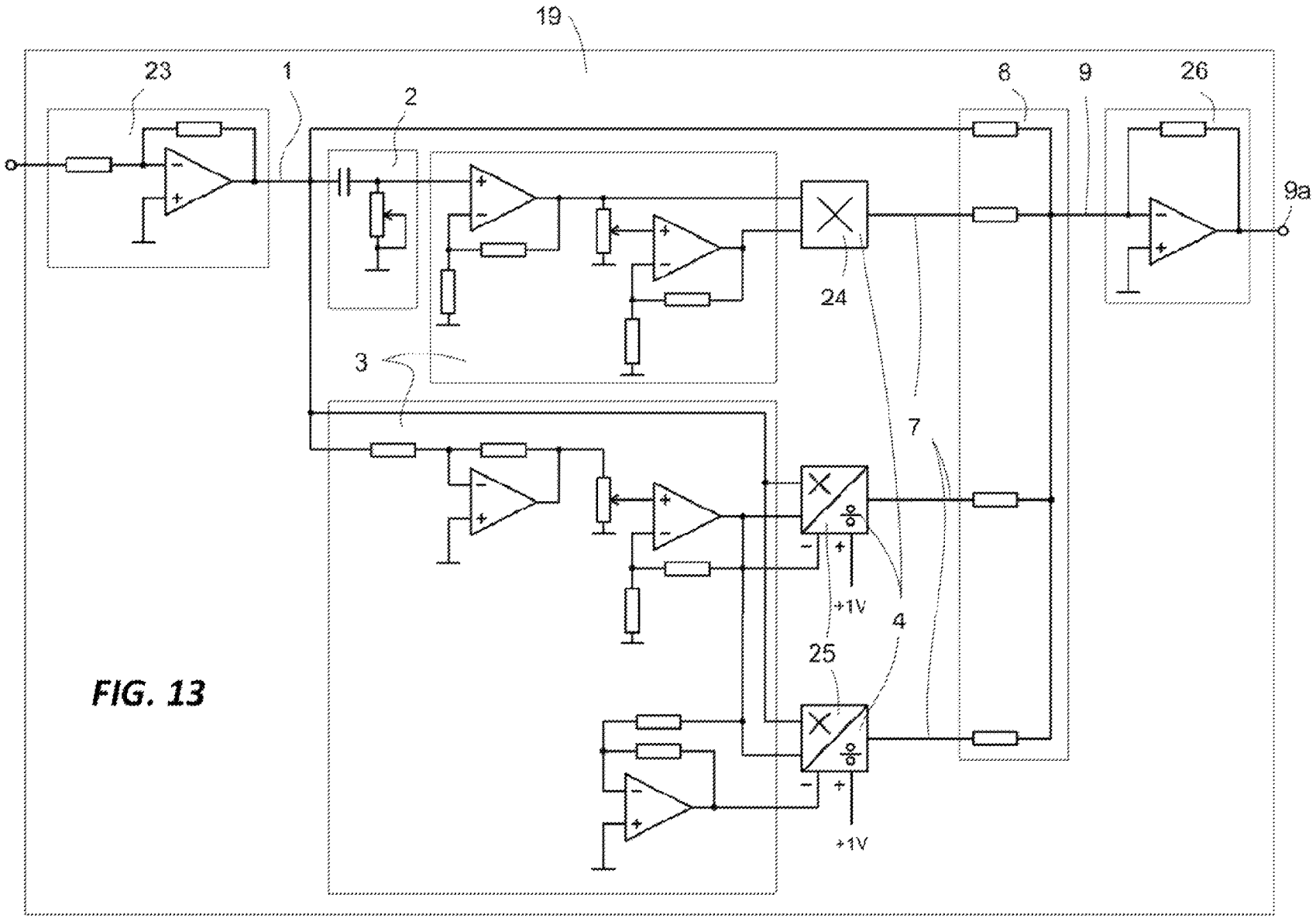
Figure 14:
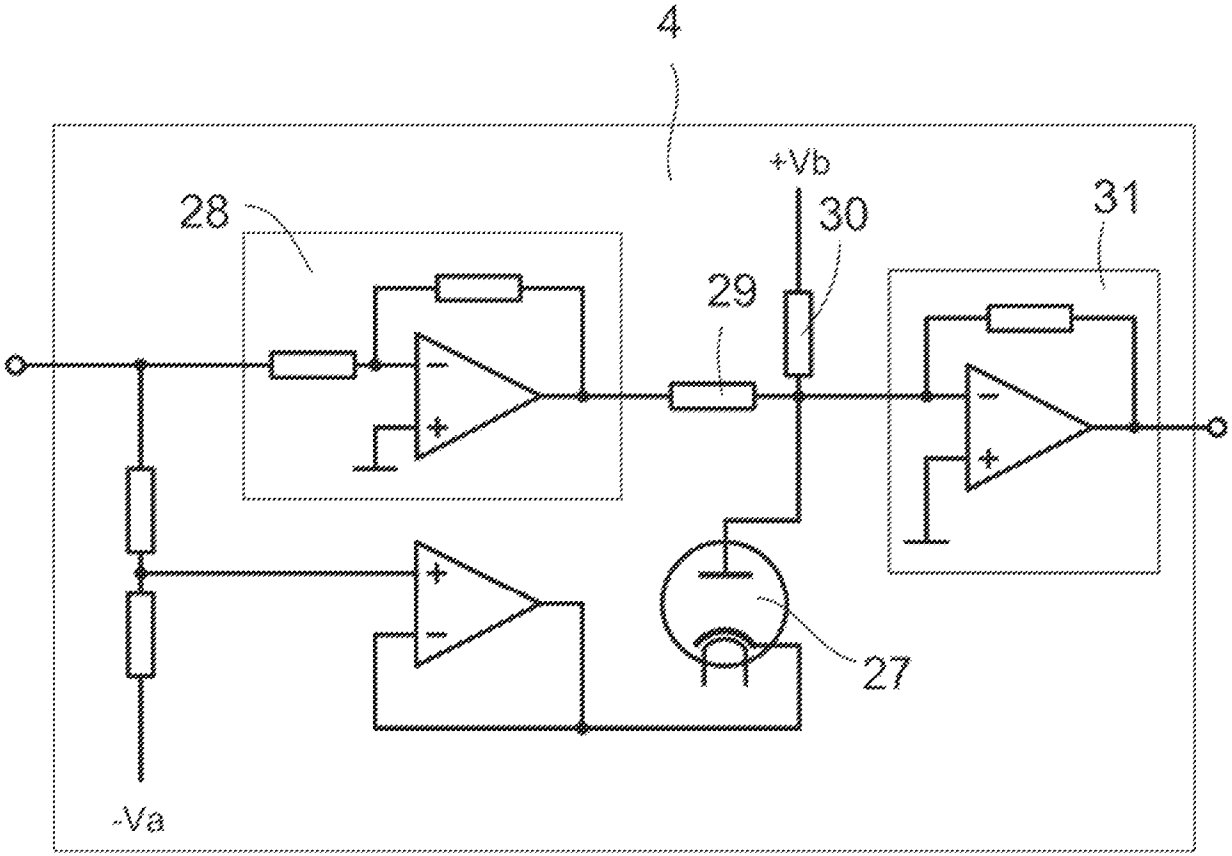

FIG. 11 schematically illustrates an audio chain according to a preferred way of performing the present invention;

FIG. 12 schematically illustrates an audio chain according to another performance method of the present invention;

FIG. 13 illustrates one of the embodiments of an apparatus for an audio signal processing according to the present invention by using quadratic and hyperbolic non-linearities; and FIG. 14 illustrates implementation of a non-linear element employing a vacuum diode.

DETAILED DESCRIPTION OF THE INVENTION

A method of the present invention takes into consideration one non-linearity of an electroacoustic transducer and non-linearity of the human ear.

According to the present invention, an audio signal processing method in an audio chain, which corrects the non-linearity of the electroacoustic transducers in the audio chain, taking into account also the non-linear psychoacoustical characteristic of the human ear, comprises approximating the psychoacoustical characteristics of the human ear by a fifth degree polynomial function, and adding of at least one non-linear element 4 in front of at least one electroacoustic transducer in the audio chain, said non-linear element 4 has a function to add a non-linearity in the audio chain that corrects the non-linearity of at least one electroacoustic transducer and/or the non-linearity of the approximated psychoacoustical characteristic of the human ear for a pressure change by the human ear up to $p_\Delta$. According to the present method, the non-linear element 4 reduces the non-linearity of the electroacoustic transducer by applying a quadratic non-linearity which is an inverse function of $ax+bx^2$ where x is a relative membrane excursion or a relative force on a membrane of the electroacoustic transducer, a and b are positive constants.

According to the one embodiment of the invention, the non-linear element 4 reduces the non-linearity of the psychoacoustical characteristic of the human ear $x-a\,x^2-b\,x^3-c\,x^4-d\,x^5$ by applying the function which reduces at least two times the non-linearities introduced by the members $x^2$, $x^3$ and $x^4$, wherein the constants $$a=10^{-\frac{44.5}{20}},\ b=10^{-\frac{79.5}{20}},\ c=10^{-\frac{101}{20}},\ d=10^{-\frac{130}{20}}$$

stay within the tolerances±30% for each constant and x is a relative pressure by the human ear.

According to the other embodiment of the invention, the non-linear element 4 reduces the non-linearity of the psychoacoustical characteristic of the human ear by applying the hyperbolic function $$\frac{x^2}{1-x}\text{ and }\frac{x^2}{1+x},$$

where x is the relative pressure by the human ear.

According to another embodiment of the invention, the non-linear element 4 reduces the non-linearity of the psychoacoustical characteristic of the human ear by applying the function $x^{1.5}$, where x is the relative pressure by the human ear.

The present method will be further described in more detail and in accordance with the embodiment of the audio chain according to the present invention.

The non-linearity within the electroacoustic transducer is defined by an adiabatic process defined as:

$$0pV^n=\text{const} \quad [1]$$

Said non-linearity within the electroacoustic transducer affects the quality of sound. In the case of the electroacoustic transducer that produces sound by moving the membrane, the air by the membrane changes the pressure by adiabatic process. The volume of air being compressed is unknown. However, changes in air pressure can be measured. A larger volume of air being compressed requires a greater membrane excursion for the same pressure and vice versa. As the air pressure changes by adiabatic process, the same membrane excursion in the direction that increases the pressure, will create greater pressure change that the excursion in the opposite direction. We will consider two ideal cases. In both cases the mass of the membrane is negligibly small, and it is rigid. In the first case, the membrane excursion is linear and the volume of the compressed air changes linearly with the membrane excursion. We will use the adiabatic process of air. The initial air pressure is atmospheric pressure. Adiabatic equation for air is:

$$pV^{1.4}=\text{const} \quad [2]$$

As the membrane moves, the volume changes, which changes the air pressure adiabatically:

$$p = \frac{const}{V^{1.4}}. \quad [3]$$

Air pressure by the membrane is:

$$p = \frac{const}{(V_0 - V_\Delta)^{1.4}} \quad [4]$$

where $V_0$ is the initial volume we compress, and $V_\Delta$ the volume change that occurs by moving the membrane. $V_\Delta$ has the negative sign because the volume decreases as the membrane moves forward. The initial conditions will be: const=$p_0$, $V_0$=1, and the volume change $V_\Delta$=d, where $p_0$ is atmospheric pressure and $d_r$ relative membrane excursion. Consequently, we can write:

$$p = \frac{p_0}{(1 - d_r)^{1.4}}. \quad [5]$$

If we expand the function into Taylor series according to the relative excursion d, the first five members are:

$$p=p_0(1+1.4x+1.68x^2+1.904x^3+2.0944x^4+\ldots), \quad [6]$$

$$p=p_0+p_\Delta, \quad [7]$$

where $p_\Delta$ is the pressure change:

$$p_\Delta=p_0(1.4x+1.68x^2+1.904x^3+2.0944x^4+\ldots). \quad [8]$$

For the pressure change of $p_\Delta$=1 Pa the relative membrane excursion is:

$$d_r \approx \frac{p_\Delta}{1.4p_0} = \frac{1}{1.4 \cdot 10^5} = 7.14 \cdot 10^{-6}. \quad [9]$$

If we put it in Taylor series, the members after the quadratic member are negligible:

$$p_0(1.904x^3+2.0944x^4+\ldots)\approx 0. \quad [10]$$

The greatest non-linearity at normal loudness is the quadratic function of the pressure change $$p_\Delta \approx p_0(1.4x+1.68x^2). \quad [11]$$

In the second case we have the force on the electroacoustic transducer membrane and the air volume that changes linearly with the membrane excursion. For easier calculation, we will use an isothermal process defined for ideal gas as:

$$pV=\text{const}. \quad [12]$$

The force on the membrane is the sum of the forces on both sides of the membrane. Since we listen to the sound only from one side of the membrane, we will monitor the pressure on that side. The force for the membrane surface is:

$$F=A_0(p_1-p_2), \quad [13]$$

where $p_1$ is the pressure on the side of the membrane facing us, $p_2$ is the pressure on the opposite side of the membrane and $A_0$ is the surface for the membrane that is constant. Pressure $p_1$, $p_2$ is:

$$p_1 = \frac{const}{V_0 - V_\Delta}, \quad p_2 = \frac{const}{V_0 + V_\Delta} \quad [14]$$

where $V_0$ is the initial volume we compress, and $V_\Delta$ the volume change that occurs by moving the membrane. The initial conditions will be const=$p_0$, $V_0$=1 and $V_\Delta$=d, where $p_0$ is atmospheric pressure, and $d_r$ the relative membrane excursion in the direction of listening. We get the equations for p1, p2:

$$p_1 = \frac{p_0}{1 - d_r}, \quad p_2 = \frac{p_0}{1 + d_r} \quad [15]$$

The force on the membrane is:

$$= A \cdot p_0\left(\frac{1}{1 - d_r} - \frac{1}{1 + d_r}\right). \quad [16]$$

If we assume that the relative force is $F_r$=F/($A_0$ $p_0$), then it is:

$$F_r = \frac{1}{1 - d_r} - \frac{1}{1 + d_r}, \quad [17]$$

and the relative membrane excursion is:

$$d_r = \frac{\sqrt{F_r^2+1}-1}{F_r}. \quad [18]$$

The pressure on the listening side is then $p_1=p_0/(1-d)$ which results in:

$$p_1 = \frac{p_0}{1-\frac{\sqrt{F_r^2+1}-1}{F_r}}. \quad [19]$$

Developed into Taylor series per the relative force $F_r$, we get the pressure on the side of the membrane facing us:

$$p_1 = p_0\left(1+\frac{x}{2}+\frac{x^2}{4}+\frac{x^4}{16}+\frac{x^6}{32}+\ldots\right), \quad [20]$$

wherein the pressure $p_1$ on the side of the membrane facing us is disclosed as:

$$p_1=p_0+p_\Delta \quad [21]$$

and the pressure change $p_\Delta$ on the side of listening is:

$$p_\Delta = p_0\left(\frac{x}{2}+\frac{x^2}{4}+\frac{x^4}{16}+\frac{x^6}{32}+\ldots\right). \quad [22]$$

For the pressure change of $p_\Delta=1$ Pa the relative membrane excursion is:

$$F_r \approx \frac{2p_\Delta}{P_0} = \frac{2}{10^5} = 2\cdot 10^{-5}. \quad [23]$$

For such a small relative force we can ignore the impact of the bigger members of Taylor series:

$$p_0\left(\frac{x^4}{16}+\frac{x^6}{32}+\ldots\right) \approx 0. \quad [24]$$

The greatest non-linearity at normal loudness is the quadratic function of pressure change $$p_\Delta \approx p_0\left(\frac{x}{2}+\frac{x^2}{4}\right). \quad [25]$$

In both cases, we can approximate the air pressure change on the membrane by quadratic function $ax+bx^2$ where x is the relative membrane excursion in the first case or relative pressure on membrane in the second case. If we consider a normal loudness with the pressure change±1 Pa by the human ear, the pressure on the membrane is greater, because the pressure decreases with the distance. The smaller the surface of the electroacoustic transducer membrane, other parameters being identical, the greater the pressure on it by the same loudness at the same distance. Assuming that, at 2 meters from the electroacoustic transducer, the pressure difference is ±1 Pa and the electroacoustic transducer has a surface $1.27^2\pi$ cm$^2$ and an ideal dispersion in all directions without sound reflection, then the acoustic power at the membrane is equal to the power at the spherical surface at some distance from the membrane. By a sphere at a 2 meters distance, this is $4\cdot 2^2\pi$ m$^2$, which makes $160000\pi$ cm$^2$. A sound power is:

$$P=I\cdot A=\text{const} \quad [26]$$

where P is a power, I is an intensity and A is a surface area. If intensity I is proportional to the square of the pressure change $I\propto p_1^2$ then we can write $p_1^2A_1=p_2^2A_2$ meaning that the pressure on the membrane in the direction of listening is $$p_\Delta = \pm 1Pa\sqrt{\frac{160000}{1.27\text{^}2}} = \pm 314.96Pa. \quad [27]$$

As the pressure on the membrane increases, the electroacoustic transducer works in a non-linear area, influencing the quality of sound we hear. For the calculated loudness $p_\Delta=p_0(ax+bx^2)$ $$x \approx \frac{p_\Delta}{ap_0}, \quad [28]$$

And the ratio of the quadratic component $bx^2$ to the linear component ax is $$\frac{bx^2}{ax} = \frac{bx}{a} = \frac{bp_\Delta}{a^2p_0}. \quad [29]$$

In the first case is a=1.4, b=1.68 and $p_\Delta$=314.96 Pa, the quadratic component is 0.27% of the linear component, which is not to be ignored. In the second case is a=½, b=¼, $p_\Delta$=314.96 Pa and the quadratic component is 0.31% of the linear component, which is also not to be ignored. To reduce the quadratic non-linearity of the electroacoustic transducer in the chain before it, we incorporate the non-linear element that corrects the non-linearity of the audio chain behind it:

$$y=a(x+bx^2) \quad [30]$$

where a and b are positive constants. The easiest way to correct the non-linearity of the electroacoustic transducer is by using the non-linear element that approximates the inverse function $x+bx^2$ which makes:

$$y^{-1} = \frac{\sqrt{bx+1}-1}{2b}. \quad [31]$$

Developed into Taylor series, we get $x-bx^2+2bx^2+2b^2x^3-5b^3x^5+\ldots$

We will take the first two members of Taylor series:

$$y^{-1}\approx x-bx^2, \quad [32]$$

And we will ignore the remaining members, because their impact is negligible when x is very small. To obtain the characteristics of the non-linear element and the audio chain after it, in $a(x+bx^2)$ we replace x with $x-bx^2$ and get $a(x-2b^2x^3+b^3x^4)$, where $|-2b^2x^3+b^3x^4| << |bx^2|$ is when x is very small. That way we reduced distortions by low values x, which is the case by listening of the audio chain at normal loudness, where the pressure change by the human ear is up to $p_\Delta = \pm 1$ Pa. If the electroacoustic transducer has a smaller membrane surface, a greater pressure will be on the membrane for the same loudness at the same distance. This will increase the adiabatic distortion of the electroacoustic transducer. It is sufficient to adjust the non-linear element to reduce at least three times the quadratic non-linearity of the electroacoustic transducer to feel a significant enhancement of sound.

SET (Single Ended Triode) tube amplifiers are known to have a non-linearity greater than 1% at rated power and are not audible to the human ear. Jean Hiraga wrote an article that received a lot of attention and criticism called *Amplifier Musicality—A Study of Amplifier Harmonic Distortion Spectrum Analysis* where he describes the harmonic structure of the non-linearity of various amplifiers and subjectively evaluates their sound. In addition to not hearing the non-linearity of SET tube amplifiers, their non-linearity overrides details of sound that we no longer hear. If we assume that the human ear has a similar non-linearity and we do not hear it, then we would not hear it even if the non-linearity were in a part of the audio chain. It is known that the frequency sine wave $f_1$ and the same one with added frequencies $f_2$, $f_3$, $f_4$, $f_5$, $f_6$ that are 2, 3, 4, 5, 6 time greater than $f_1$ where the amplitudes are: $f_1$ at 0 db, $f_2$ at −40 db, $f_3$ at −50 db, $f_4$ at −60 db, $f_5$ at −70 db and $f_6$ at −80 db will sound the same to the human ear (FIG. 2*b*). Hyperbolic function 1/(1−x) (FIG. 1*a*) has the non-linearity with such a harmonic distortion structure that each component is smaller than the previous one for the constant value (FIG. 1*b*). If the harmonic structure of the human ear is significantly disturbed, we will hear it as a change of sound. We will approximate the psychoacoustic feature of the human ear by a fifth-degree polynomial function:

$$x-ax^2-bx^3-cx^4-dx^5 \quad [33]$$

Where a, b, c and d are real positive numbers and x is the relative pressure by the human ear. To determine the values of a, b, c, and d, we add non-linearities to the audio signal until we have reached the distortion of the harmonic structure of the human ear we hear. To determine the coefficient a, we use the non-linearity $x+ax^2$ which, with an approximation of the characteristic of the human ear, gives:

$$x-(2a^2+b)x^3-(a^3+3ab+c)x^4-(3a^2b+4ac+d)x^5-\ldots \quad [34]$$

where we removed the member $x^2$ and disturbed the harmonic structure of the human ear. To determine the coefficient b, we use the non-linearity $x+bx^3$ which, with an approximation of the characteristic of the human ear, gives:

$$x-ax^2-(2ab+c)x^4-(3b^2+d)x^5-\ldots \quad [35]$$

where we removed the member $x^3$ and disturbed the harmonic structure of the human ear. To determine the coefficient c, we use the non-linearity $x+cx^4$ which, with an approximation of the characteristic of the human ear, gives:

$$x-ax^2-bx^3-(2ac+d)x^5-\ldots \quad [36]$$

where we removed the member $x^4$ and disturbed the harmonic structure of the human ear. To determine the coefficient d, we use the non-linearity $x+dx^5$ which, with an approximation of the characteristic of the human ear, gives:

$$x-ax^2-bx^3-cx^4-\ldots \quad [37]$$

where we removed the member $x^5$ and disturbed the harmonic structure of the human ear. The members $$a = 10^{-\frac{44.5}{20}},$$

$$b = 10^{-\frac{79.5}{20}},$$

$$c = 10^{-\frac{101}{20}}$$

and $$d = 10^{-\frac{130}{20}}$$

within the tolerances±30% for each member were obtained through hearing tests. Approximated function of the psychoacoustic feature of the human ear is:

$$x-10^{-\frac{44.5}{20}}x^2-10^{-\frac{79.5}{20}}x^3-10^{-\frac{101}{20}}x^4-10^{-\frac{130}{20}}x^5. \quad [38]$$

By applying the Lagrange-Bürmann formula, we get the following inverse function of the approximation of the human ear:

$$x+10^{-\frac{44.5}{20}}x^2+10^{-\frac{75}{20}}x^3+10^{-\frac{97.6}{20}}x^4+10^{-\frac{122.3}{20}}x^5+.. \quad [39]$$

Since the coefficient of the $x^5$ member of the approximated function of the psychoacoustical characteristic of the human ear is very small, it can be ignored, as well as the bigger members. In order to hear enough details, it is necessary to reduce at least two times the non-linearities introduced by the $x^2$, $x^3$ and $x^4$ members of the approximated psychoacoustic characteristics of the human ear. The inverse function of the approximation of the psychoacoustic feature of the human ear can be derived using the hyperbolic curves $$\frac{ax^2}{1-bx}$$

and $$\frac{cx^2}{1+dx},$$

where a=0.00372, b=0.06061, c=0.002484 and d=0.01313 (FIG. 5*a*). The inverse function of the approximation of the psychoacoustical characteristic of the human ear using the hyperbolic curves is:

$$x+\frac{0.003472x^2}{1-0.06061x}+\frac{0.002484x^2}{1+0.01313x}, \quad [40]$$

which, when developed into Taylor series, makes the first five members:

$$x+10^{-\frac{44.5}{20}}x^2+10^{-\frac{75}{20}}x^3+10^{-\frac{97.6}{20}}x^4+10^{-\frac{122.3}{20}}x^5 \quad [41]$$

In order to see how the non-linearity of the human ear decreases, in the approximate psychoacoustic feature of the human ear $$x - 10^{-\frac{44.5}{20}}x^2 - 10^{-\frac{79.5}{20}}x^3 - 10^{-\frac{101}{20}}x^4 - 10^{-\frac{130}{20}}x^5$$

we replace x with $$x + 10^{-\frac{44.5}{20}}x^2 + 10^{-\frac{75}{20}}x^3 + 10^{-\frac{97.6}{20}}x^4 + 10^{-\frac{122.3}{20}}x^5$$

and obtain the first five members:

$$x + 10^{-\frac{120.5}{20}}x^3 + 10^{-\frac{146.5}{20}}x^4 + 10^{-\frac{177.5}{20}}x^5. \quad [42]$$

Since $$2 \cdot 0 \leq 10^{-\frac{44.5}{20}},$$

$$2 \cdot 10^{-\frac{120.5}{20}} \leq 10^{-\frac{79.5}{20}}$$

and $$2 \cdot 10^{-\frac{146.5}{20}} \leq 10^{-\frac{101}{20}},$$

we reduced at least two times the non-linearities introduced by the $x^2$, $x^3$ and $x^4$ members of the approximated psychoacoustic characteristics of the human ear.

According to the present invention, an apparatus for the implementation of the method comprises at least one non-linear element 4 in the audio chain that has the function of adding the non-linearity to the audio chain that corrects the non-linearity of at least one electroacoustic transducer and/or the non-linearity of the approximate psychoacoustical characteristic of the human ear for the pressure change by the human ear to $p_\Delta$.

FIG. 7 schematically illustrates an apparatus 19 for implementing a general method of adding non-linearities in the audio signal in accordance with the present invention. An input audio signal 1 routes into a non-isolated part of the audio signal 1 and at least one isolated audio signal 1; said isolated audio signals 1 are being processed by using the non-linear element 4 in at least one isolated non-linear audio signal 7, and in an adder 8 the non-isolated part of audio signal 1 is combined/merged with at least one isolated non-linear audio signal 7 into a processed output audio signal 9. The branch creating non-linearities comprises: an optional filter 2 before the non-linear element 4, an optional amplifier/attenuator 3 before the non non-linear element 4, the non-linear element 4, an optional amplifier/attenuator 5 after the non-linear element 4 and an optional filter 6 after the non-linear element 4. The non-linear element 4 will have a quadratic function $-x^2$ or hyperbolic functions $$\frac{x^2}{1-x}$$

and $$\frac{x^2}{1+x}.$$

A method for audio signal processing in the audio chain carried out by using the apparatus 19 illustrated in FIG. 7, the method correcting the non-linearity of the electroacoustic transducers in the audio chain taking into account also the non-linear psychoacoustical characteristic of the human ear, comprises the following steps: splitting of an input audio signal 1 into a non-isolated part of the audio signal 1 and at least one isolated audio signal 1; modifying of at least one isolated audio signal 1 in the non-linear element 4 by adding non-linearities; optionally amplification/attenuation of at least one isolated audio signal in the amplifier/attenuator 3 before the non-linear element 4 and optionally amplification/attenuation of at least one isolated audio signal in the amplifier/attenuator 5 after the non-linear element 4, and optionally filtering of at least one isolated audio signal in the filter 2 before the non-linear element 4 and optionally filtering of at least one isolated audio signal in the filter 6 after the linear element 4, and obtaining at least one isolated non-linear audio signal 7; and combining a non-isolated part of the audio signal 1 with at least one isolated non-linear audio signal 7 in the adder 8 into the output audio signal 9.

FIG. 8 schematically illustrates one embodiment of a non-linear square element 4. Before the non-linear element 4 there is the amplifier/attenuator 3 having positive value a, the non-linear element 4 having the quadratic function $-x^2$ and the amplifier/attenuator 5 after the non-linear element 4, said amplifier/attenuator 5 has positive value b. The quadratic non-linear element 4 is derived from a signal multiplier 10 that multiplies the output signal after the amplifier/attenuator 3 with itself and changes its sign in a signal inverter 11. The total transfer function of the circuit on the FIG. 8 is $-(ax)^2b=-a^2bx^2$. By adjusting the values a and b, we can control how much of the quadratic non-linearity we will add to a linear part of the signal.

FIG. 9 schematically illustrates the embodiment of a non-linear hyperbolic element 4. The amplifier/attenuator 3 before the non-linear element 4 has positive value a, the non-linear element 4 having hyperbolic function $$\frac{x^2}{1-x}$$

and the amplifier/attenuator 5 after the non-linear element 4 for the positive value b. The hyperbolic non-linear element 4 is derived from the signal inverter 11, a source 12 of the value of the constant 1, a signal adder 13, a signal scaler 14 and the signal multiplier 10. At the signal adder 13 output is $1-x$ where the signal further enters the signal scaler 14 that splits the signal $x \div (1-x)$ which the signal multiplier 10 multiplies by x and $$\frac{x^2}{1-x}$$

is obtained. The total transfer function of the circuit on the FIG. 9 is $$\frac{(ax)^2}{1-ax}b = \frac{a^2x^2}{1-ax}b.$$

By adjusting the values a and b we can obtain any function $$\frac{cx^2}{1-dx}$$

where c and d are arbitrary positive values.

FIG. 10 schematically illustrates the derivation of the non-linear hyperbolic element 4, the amplifier/attenuator 3 being before the non-linear element 4 and having positive value a, non-linear element 4 having hyperbolic function $$\frac{x^2}{1+x}$$

and amplifier/attenuator 5 after the non-linear element 4 having positive value b. The hyperbolic non-linear element 4 is derived from the source 12 of the value of the constant 1, the signal adder 13, the signal scaler 14, the signal multiplier 10 and the signal inverter 11. At the signal adder 13 output is $$\frac{x^2}{1-x}$$

where the signal further enters the signal scaler 14 that splits the signal x÷(1+x) which the signal multiplier 10 multiplies by x and $$\frac{x^2}{1+x}$$

is obtained. The total transfer function of the circuit on the FIG. 10 is $$\frac{(ax)^2}{1+ax}b = \frac{a^2x^2}{1+ax}b.$$

By adjusting the values a and b we can obtain any function $$\frac{cx^2}{1+dx}$$

where c and d are arbitrary positive values.

FIG. 11 illustrates the preferred audio chain embodiment comprising at least one apparatus 19 and of the method for audio signal processing in said audio chain. The audio chain comprises a pre-amplifier 16 of an input audio signal 15 connected to a first apparatus 19 for audio signal processing by using the hyperbolic non-linearities, an audio crossover 18 connected to the first apparatus 19 (after the first apparatus 19), the audio crossover 18 that splits the processed audio signal in a second apparatus 19 into two signal branches by frequency range. At least two second apparatuses 19 for audio signal processing by using quadratic non-linearity are connected to the audio crossover 18 (after the audio crossover), and to each of the two said second apparatuses 19 a respective power amplifier 20 is connected, as well as a two electroacoustic transducers 21 which are connected to the respective power amplifier 20. The original input audio signal 15 enters the pre-amplifier 16 that controls loudness. The signal from the pre-amplifier 16 goes to the first apparatus 19 for audio signal processing by using hyperbolic non-linearities. The processed signal from the first apparatus 19 goes to the audio crossover 18 that splits the signal into more branches by frequency range. After the audio crossover 18, the signal from each branch goes to the second associated apparatus 19 for audio signal processing by using quadratic non-linearity. The processed signal from each second associated apparatus 19 goes to the associated power amplifier 20 that routes the amplified signal to an associated electroacoustic transducer 21. Each of the second apparatuses 19 for signal processing by using quadratic non-linearity is configured to reduce at least three times the quadratic non-linearity of the electroacoustic transducers 21, taking into account the amplification of the power amplifier 20 that affects the required amount of non-linearity. If the amplification is higher, larger quadratic non-linearity is required on the associated second apparatuses 19. The first apparatus 19 for signal processing by using hyperbolic non-linearities is configured to reduce at least two times the non-linearity of the psychoacoustic feature of the human ear within the area of the pressure change $p_\Delta = \pm 1$ Pa, taking into account the amplification of the power amplifier 20, an efficiency of the electroacoustic transducer 21 and a distance the human ear is at from the electroacoustic transducers. If the amplification is greater and/or the efficiency of the electroacoustic transducer is greater and/or the distance of the human ear from the electroacoustic transducer is smaller, larger hyperbolic non-linearities on the first signal processing apparatus 19 are also required.

The audio signal processing method in audio chain as illustrated in FIG. 11, that is carried out with the apparatus 19, and which method corrects the non-linearity of electroacoustic transducers in audio chain taking into account also the non-linear psychoacoustical characteristic of the human ear, comprises the following steps: amplification/attenuation of the input signal 15 in the adjustable preamplifier 16; audio signal processing in the first apparatus 19 by applying hyperbolic non-linearity; splitting audio signals into two branches by frequency range in the audio crossover 18; processing the split audio signals in each branch in the second apparatus 19 by applying quadratic non-linearity; power amplification of the split audio signals in each branch in power amplifiers 20, and routing audio signals of each branch to the associated electroacoustic transducer 21.

The other embodiment of the apparatus 19 and of the method within audio chain is illustrated in FIG. 12. The input audio signal 15 enters the pre-amplifier 16 that controls loudness. The signal from the pre-amplifier 16 flows to the first apparatus 19 for audio signal processing by using quadratic and hyperbolic non-linearities. The processed signal from the first apparatus 19 flows to the power amplifier 20 which delivers the amplified signal to the audio crossover 18 that splits the signal into more branches by frequency range. After the audio crossover 18, the signal from each branch flows to the corresponding electroacoustic transducer 21. The signal processing apparatus 19 by using quadratic and hyperbolic non-linearities is configured to reduce at least three times the quadratic non-linearity of the electroacoustic transducers 21, taking into account the amplification of the power amplifier 20 that affects the required amount of quadratic non-linearities. Also, the apparatus 19 is configured to reduce at least two times the non-linearity of the psychoacoustic feature of the human ear within an area of pressure change $p_\Delta = \pm 1$ Pa, taking into account the amplification of the power amplifier 20, the efficiency of the electroacoustic transducer 21 and the distance the human ear is at from the electroacoustic transducers. If the amplification is greater and/or the efficiency of the electroacoustic transducer is greater and/or the distance of the human ear from the electroacoustic transducer is smaller, larger hyperbolic non-linearities on the apparatus 19 are also required. As the apparatus 19 reduces quadratic non-linearities for several electroacoustic transducers that have different quadratic non-linearities and work in different frequency ranges, the apparatus applies the filters 2 before the non-linear element 4 and/or filters 6 after the non-linear element 4 so that it adjusts quadratic non-linearity for different frequency ranges. The apparatus 19 is designed to use quadratic and hyperbolic non-linearities by simultaneously adding them to the input audio signal 1 within the adder 8 or is made as a chain of apparatuses 19 connected in a series connection.

The audio signal processing method in audio chain shown on the FIG. 12, that is carried out with the apparatus 19, and which method corrects the non-linearity of electroacoustic transducers in audio chain taking into account also the non-linear psychoacoustical characteristic of the human ear, comprises the following steps: amplification/attenuation of the input signal 15 in the adjustable preamplifier 16; audio signal processing in the first apparatus 19 by using quadratic and hyperbolic non-linearities; amplification of the audio signal in power amplifier 20; splitting audio signals into two branches by frequency range in the audio crossover 18; and routing signals of each branch to the associated electroacoustic transducer 21.

According to the method of the present invention, the apparatus 19 reduces by two times the non-linearity of the approximated psychoacoustical characteristic of the human ear and/or by 3 times the quadratic non-linearity of the electroacoustic transducer, and the pressure change by the human ear up to $p_\Delta = \pm 1$ Pa.

Furthermore, according to the method of the present invention, the audio signal can be processed either in an analogue format or in a digital format.

The present invention relates also to a computer program adapted to run on a processor and to perform the method steps according to the present invention when carried out on a computer device.

FIG. 13 illustrates an embodiment of the apparatus 19 using as non-linear elements an analogue multiplier 24 to obtain quadratic characteristic and analogue multipliers/scalers 25 to obtain hyperbolic characteristics. The input audio signal 1 arrives at an inverting input stage 23 after which the signal flows to different branches with non-linear elements 4. The first branch has the input filter 2 constructed as an adjustable first-order high-pass RC filter, an adjustable amplifier/attenuator 3 constructed by using operational amplifiers, resistors and a potentiometer and a non-linear element 4 made as the analogue multiplier 24. The second and the third signal processing branches are implemented from a joint adjustable amplifier/attenuator 3 for easier adjusting, constructed by using operational amplifiers, resistors and a potentiometer, as well as single non-linear elements 4 made by using analogue multipliers/scalers 25 having the characteristic $$\frac{x \cdot y}{1 - z}.$$

The outputs of three branches of non-linear parts of the signal 7 enter the adder 8 made of a resistor network that converts the non-linear output voltage signals 7, as well as the audio signal after the input stage 23, into a sum of currents that make up the output audio signal 9, where the output inverting stage 26 converts them into the output voltage 9*a*.

The inverse psychoacoustic feature of the human ear can be approximated also by other functions and derivations of the non-linear element 4 can be performed by applying non-linearities of electronic elements such as diodes, transistors and vacuum tubes. FIG. 6*a* illustrates an approximation of the non-linearity of the inverse function of the human ear $$10^{-\frac{44.5}{20}} x^2 + 10^{-\frac{75}{20}} x^3 + 10^{-\frac{97.6}{20}} x^4 + 10^{-\frac{122.3}{20}} x^5$$

by non-linearity $x^{1.5}$, which corresponds to the current/voltage characteristic of the vacuum diode $I = k \cdot U^{1.5}$. The approximation on the FIG. 6*a* is characterized by $x + ((a-x)^{1.5} - a^{1.5} + 1.5 \cdot a^{0.5}\ x) \cdot b$, being a=5.31423 and b=0.0366175 (full line) and when developed in Taylor series, the first five members are obtained:

$$x + 10^{-\frac{44.5}{20}} x^2 + 10^{-\frac{74.6}{20}} x^3 + 10^{-\frac{97.6}{20}} x^4 + 10^{-\frac{118.1}{20}} x^5.$$

In order to see how the non-linearity of the human ear decreases, in the approximate psychoacoustic feature of the human ear $$x - 10^{-\frac{44.5}{20}} x^2 - 10^{-\frac{79.5}{20}} x^3 - 10^{-\frac{101}{20}} x^4 - 10^{\frac{130}{20}} x^5$$

we replace x with $$x + 10^{-\frac{45}{20}} x^2 + 10^{-\frac{74.6}{20}} x^3 + 10^{-\frac{97.6}{20}} x^4 + 10^{-\frac{118.1}{20}} x^5$$

and obtain the first five members:

$$x + 10^{-\frac{100}{20}} x^3 - 10^{\frac{145.6}{20}} x^4 + 10^{-\frac{126.5}{20}} x^5.$$

Since $2 \cdot 0 \le 10^{-\frac{44.5}{20}}$, $2 \cdot 10^{-\frac{100}{20}} \le 10^{-\frac{79.5}{20}}$ and $2 \cdot 10^{-\frac{145.6}{20}} \le 10^{-\frac{101}{20}}$, we reduced at least two times the non-linearities introduced by the $x^2$, $x^3$ and $x^4$ members of the approximated psychoacoustic characteristics of the human ear.

The implementation of the non-linear element 4 by applying vacuum diodes is illustrated in FIG. 14. The input signal flows to a resistor network connected to a constant voltage −Va, that adds a DC component to the input signal that flows to voltage followers made by the means of operational amplifiers. After the voltage followers, the signal flows to a vacuum diode 27 that has a current/voltage characteristic $I = k \cdot U^{15}$. The linear component was removed by applying an inverting amplifier 28 and a resistor 29 that converts the output voltage of the inverting amplifier 28 into a current which is summed up by the current of the vacuum diode 27. The DC component was removed by applying constant voltage +Vb and a resistor 30. The sum of the currents of the vacuum diode 27, the resistor 29 and a resistor 30 is converted to an output voltage on an inverting amplifier 31. Transmission characteristics of the entire circuit is $((a-x)^{1.5} - b + cx) \cdot d$, a, b, c and d being positive values.

The invention claimed is:

1. An audio signal processing method in an audio chain that corrects a non-linearity of electroacoustic transducers in the audio chain, taking into account a non-linear psychoacoustical characteristic of the human ear, the method comprising:

adding of at least one non-linear element in front of at least one electroacoustic transducer in the audio chain, each non-linear element adding a non-linearity in the audio chain to correct a non-linearity of an amplitude of at least one electroacoustic transducer and to apply a polynomial approximation of non-linearity of a human ear to a pressure change up to $p_\Delta$, wherein a correction of the non-linearity of the electroacoustic transducer is performed by applying a quadratic non-linearity function which is an inverse function of $ax+bx^2$ where x is a relative membrane excursion or a relative force on a membrane of the electroacoustic transducer, where a and b are positive constants, wherein the non-linear element applies the non-linear psychoacoustical characteristic of the human ear expressed as a fifth-degree polynomial function $x-ax^2-bx^3-cx^4-dx^5$, wherein a, b, c and d are real positive numbers determined by an approximation of the characteristic of the human ear within the tolerances ±30% for each member and x is a relative pressure by the human ear, by applying an inverse function to the fifth-degree polynomial function which reduces at least two times any non-linearities introduced by the members $x^2$, $x^3$ and $x^4$.

2. The method according to claim 1, wherein the non-linear element applies the non-linear psychoacoustical characteristic of the human ear by the hyperbolic function $$\frac{x^2}{1-x} \text{ and } \frac{x^2}{1+x}$$

to express the inverse function, where x is the relative pressure by the human ear.

3. The method according to claim 1, wherein the non-linear element applies the non-linear psychoacoustical characteristic of the human ear by the function $x^{1.5}$ to express the inverse function, where x is the relative pressure by the human ear.

4. The method according to claim 1, wherein the non-linear element applies the non-linear psychoacoustical characteristic of the human ear by the Lagrange-Bürmann formula to express the inverse function, where x is the relative pressure by the human ear.

5. The method according to claim 1, wherein a, b, c and d are $$a = 10^{-\frac{44.5}{20}},\ b = 10^{-\frac{79.5}{20}},\ c = 10^{-\frac{101}{20}} \text{ and } d = 10^{-\frac{130}{20}}.$$

6. The method according to claim 1, wherein the method comprises the following steps:

routing of an input audio signal to a non-isolated part of the input audio signal and at least one isolated audio signal;

modifying at least one isolated audio signal in the non-linear element by adding non-linearities;

amplification/attenuation of at least one isolated audio signal in an amplifier/attenuator before the non-linear element and amplification/attenuation of at least one isolated audio signal in an amplifier/attenuator after the non-linear element, and filtering of at least one isolated audio signal in a filter before the non-linear element and filtering of at least one isolated audio signal in a filter after the linear element, and obtaining at least one isolated non-linear audio signal; and combining the non-isolated part of the audio signal and at least one isolated non-linear audio signal in an adder into an output audio signal.

7. The method according to claim 1, wherein the method comprises the following steps:

amplification/attenuation of an input signal in an adjustable preamplifier;

audio signal processing in a first apparatus by applying hyperbolic non-linearity;

splitting audio signals into two branches by frequency range in an audio crossover (18);

processing the split audio signals in each branch in at least one second apparatus by applying quadratic non-linearity;

amplification of a power of the split audio signals in each branch in power amplifiers, and routing audio signals of each branch to an associated electroacoustic transducer.

8. The method according to claim 1, wherein the method comprises the following steps:

amplification/attenuation of the input signal in the adjustable preamplifier;

audio signal processing in the first apparatus by applying quadratic and hyperbolic non-linearity;

audio signal power amplification in the power amplifier;

splitting audio signals into two branches by frequency range in the audio crossover; and routing audio signals of each branch to the associated electroacoustic transducer.

9. The method according to claim 1, wherein the method reduces at least 2 times the non-linearity of the approximated psychoacoustic feature of the human ear.

10. The method according to claim 1, wherein the method reduces at least 3 times the quadratic non-linearity of the electroacoustic transducer.

11. The method according to claim 1, wherein the pressure change by the human ear is up to $p_\Delta=\pm 1$ Pa.

12. A computer device, comprising:

a processor;

a computer program executable on the processor of the computer device to perform the following steps:

receive an input audio signal;

modify the input audio signal by adding a non-linearity to the input audio signal to correct a non-linearity of an amplitude of at least one electroacoustic transducer and to apply a polynomial approximation of non-linearity of a human ear to a pressure change up to $p_\Delta$, wherein a correction of the non-linearity of the electroacoustic transducer is applied by an inverse function of $ax+bx^2$ where x is a relative membrane excursion or a relative force on a membrane of the electroacoustic transducer, where a and b are positive constants, and wherein a correction of non-linearity of the human ear is applied by an inverse function of $x-ax^2-bx^3-cx^4-dx^5$, wherein a, b, c and d are real positive numbers and x is a relative pressure by the human ear to thereby obtain an isolated non-linear audio signal; and combine the input audio signal with the isolated non-linear audio signal to provide an output audio signal.

13. The computer device of claim 12, wherein the correction of non-linearity of the human ear reduces the non-linearity of the human ear at least 2 times.

14. The computer device of claim 12, wherein the correction of the non-linearity of the electroacoustic transducer reduces the non-linearity of the electroacoustic transducer at least 3 times.

15. An audio signal processing apparatus, comprising:

an input stage for receiving an audio signal;

a divider dividing the audio signal into parallel branches;

a first audio signal processing stage being an adjustable amplifier/attenuator having operational amplifiers, resistors, a potentiometer and an analog multiplier in a first parallel branch, said first audio processing stage modifying the received audio signal by adding a non-linearity to the received audio signal to correct a non-linearity of an amplitude of at least one electroacoustic transducer by applying an inverse function of $ax+bx^2$, where x is a relative membrane excursion or a relative force on a membrane of the electroacoustic transducer, where a and b are positive constants, to provide a first audio signal processing stage output;

a second audio signal processing stage being an adjustable amplifier/attenuator having operational amplifiers, resistors, a potentiometer, and analog $(x \cdot y)/(1-z)$ multipliers/scalers in a second parallel branch, the second audio signal processing stage modifying the received audio signal by adding a non-linearity to the received audio signal to correct non-linearity of the human ear by applying an inverse function of $x-ax^2-bx^3-cx^4-dx^5$, wherein a, b, c and d are real positive numbers and x is a relative pressure by the human ear, to provide a second audio signal processing stage output; and an adder combining the received audio signal with first audio signal processing stage output and the second audio signal processing stage output to provide a pre-output audio signal.

16. The audio signal processing apparatus of claim 15, further comprising:

the input stage being an inverting input stage.

17. The audio signal processing apparatus of claim 15, further comprising:

an inverting output stage to convert the pre-output audio signal to an output voltage.

18. The audio signal processing apparatus of claim 15, further comprising:

an audio crossover for splitting the pre-output audio signal into two split audio signals according to frequency range;

a second audio signal processing apparatus for receiving a first frequency range audio signal from the audio crossover, the second audio signal processing apparatus having a first audio signal processing stage being an adjustable amplifier/attenuator having operational amplifiers, resistors, a potentiometer and an analog multiplier in a first parallel branch, said first audio processing stage modifying the received audio signal by adding a non-linearity to the received audio signal to correct a non-linearity of an amplitude of at least one electroacoustic transducer by applying an inverse function of $ax+bx^2$, where x is a relative membrane excursion or a relative force on a membrane of the electroacoustic transducer, where a and b are positive constants, to provide a first frequency range first audio signal processing stage output, and a second audio signal processing stage being an adjustable amplifier/attenuator having operational amplifiers, resistors, a potentiometer, and analog $(x \cdot y)/(1-z)$ multipliers/scalers in a second parallel branch, the second audio signal processing stage modifying the received audio signal by adding a non-linearity to the received audio signal to correct non-linearity of the human ear by applying an inverse function of $x-ax^2-bx^3-cx^4-dx^5$, wherein a, b, c and d are real positive numbers and x is a relative pressure by the human ear, to provide a first frequency range second audio signal processing stage output, and an adder combining the first frequency range audio signal with first frequency range first audio signal processing stage output and the first frequency range second audio signal processing stage output to provide a first frequency range pre-output audio signal; and a third audio signal processing apparatus for receiving a second frequency range audio signal from the audio crossover, the third audio signal processing apparatus having a first audio signal processing stage being an adjustable amplifier/attenuator having operational amplifiers, resistors, a potentiometer and an analog multiplier in a first parallel branch, said first audio processing stage modifying the received audio signal by adding a non-linearity to the received audio signal to correct a non-linearity of an amplitude of at least one electroacoustic transducer by applying an inverse function of $ax+bx^2$, where x is a relative membrane excursion or a relative force on a membrane of the electroacoustic transducer, where a and b are positive constants, to provide a second frequency range first audio signal processing stage output, and a second audio signal processing stage being an adjustable amplifier/attenuator having operational amplifiers, resistors, a potentiometer, and analog $(x \cdot y)/(1-z)$ multipliers/scalers in a second parallel branch, the second audio signal processing stage modifying the received audio signal by adding a non-linearity to the received audio signal to correct non-linearity of the human ear by applying an inverse function of $x-ax^2-bx^3-cx^4-dx^5$, wherein a, b, c and d are real positive numbers and x is a relative pressure by the human ear, to provide a second frequency range second audio signal processing stage output, and an adder combining the second frequency range audio signal with second frequency range first audio signal processing stage output and the second frequency range second audio signal processing stage output to provide a first frequency range pre-output audio signal.

* * * * *